US011186975B2

(12) United States Patent
Kitaura et al.

(10) Patent No.: US 11,186,975 B2
(45) Date of Patent: Nov. 30, 2021

(54) FLUSH WATER TANK APPARATUS AND FLUSH TOILET APPARATUS COMPRISING FLUSH WATER TANK APPARATUS

(71) Applicant: TOTO LTD., Kitakyushu (JP)

(72) Inventors: Hidekazu Kitaura, Kitakyushu (JP); Nobuhiro Hayashi, Kitakyushu (JP); Akihiro Shimuta, Kitakyushu (JP); Masahiro Kuroishi, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 16/984,495

(22) Filed: Aug. 4, 2020

(65) Prior Publication Data

US 2021/0040717 A1 Feb. 11, 2021

(30) Foreign Application Priority Data

Aug. 5, 2019 (JP) ..... JP2019-143531
Nov. 7, 2019 (JP) ..... JP2019-202294
May 27, 2020 (JP) ..... JP2020-091983

(51) Int. Cl.
*E03D 1/28* (2006.01)
*E03D 5/10* (2006.01)
*E03D 1/34* (2006.01)

(52) U.S. Cl.
CPC ..... *E03D 1/286* (2013.01); *E03D 1/34* (2013.01); *E03D 5/10* (2013.01)

(58) Field of Classification Search
CPC ..... E03D 1/286; E03D 1/34; E03D 5/10
USPC ..... 4/329
See application file for complete search history.

(56) References Cited

U.S. PATENT DOCUMENTS

2010/0212696 A1* 8/2010 Shirai ..... E03D 11/08 134/22.1
2020/0190782 A1* 6/2020 Kochavi ..... E03D 3/00

FOREIGN PATENT DOCUMENTS

DE 10306661 A1 * 3/2005 ..... E03D 5/01
JP H10-311073 A 11/1998
JP 2009-257061 A 11/2009

* cited by examiner

*Primary Examiner* — Christine J Skubinna
(74) *Attorney, Agent, or Firm* — Studebaker & Brackett PC

(57) ABSTRACT

A flush water tank apparatus supplying flush water to a flush toilet by using electrical power generated in the flush water tank apparatus, and a flush toilet apparatus including the flush water tank apparatus are provided. The flush water tank apparatus includes a discharge valve hydraulic drive portion, a discharge control device, an electromagnetic valve, a branching portion causing supplied tap water to flow into the discharge control device and into the water supply valve respectively, and a generator generating electrical power to operate the electromagnetic valve. The generator is provided on a water conduit in a downstream side of the branching portion, and on the water conduit in an upstream side of the water supply valve or in a downstream side of the water supply valve.

10 Claims, 7 Drawing Sheets

FLUSH WATER TANK APPARATUS AND FLUSH TOILET APPARATUS COMPRISING FLUSH WATER TANK APPARATUS

CROSS-REFERENCE TO RELATED APPLICATION

This application claims benefit of priority to Japanese Patent Application No. 2019-143531, filed Aug. 5, 2019, Japanese Patent Application No. 2019-202294, filed Nov. 7, 2019, and Japanese Patent Application No. 2020-091983, filed May 27, 2020, the entire contents of which are incorporated herein by reference.

BACKGROUND

Technical Field

The present disclosure relates to a flush water tank apparatus, and particularly to a flush water tank apparatus supplying flush water to a flush toilet by using electrical power generated in the flush water tank apparatus and flush toilet apparatus comprising the flush water tank apparatus.

Background Art

Published Unexamined Patent Application 2009-257061 describes a low tank apparatus. This low tank apparatus comprises a water pressure cylinder apparatus, and is constituted so that a water pressure cylinder is activated by the water pressure of supplied water to open a discharge valve in the low tank apparatus. In this low tank apparatus the supply and shutting off of a water supply to a water pressure cylinder is controlled by an electromagnetic valve. opening and closing of the discharge valve are controlled by operation of the electromagnetic valve. That is, when water supplied by activating an electromagnetic valve is caused to flow into the hydraulic cylinder apparatus, the piston in the hydraulic cylinder is pushed up, and this movement of the piston pulls up the discharge valve, thereby the discharge valve is opened. The discharge valve is closed when supply of water to the hydraulic cylinder apparatus is stopped by the electromagnetic valve.

A toilet tank apparatus is set forth in Published Unexamined Patent Application H10-311073. In the toilet tank apparatus, an electromagnetic valve, to which a water supply pipe is connected, is provided on the upper side surface of a tank main body, and a turbine is connected on the outflow side of this electromagnetic valve. A generator is attached to this turbine, and a rectifier circuit for converting AC power from the generator into DC, a battery charged by DC power from the rectifier circuit, and an electromagnetic valve control circuit operated by electrical power from the battery are provided on a circuit board.

SUMMARY

However, in the low tank apparatus described in Published Unexamined Patent Application 2009-257061, the hydraulic cylinder apparatus is operated by the electromagnetic valve, there is a problem that the apparatus cannot be provided in environments where no external power supply is available. It is tried to consider that a generator is provided on the low tank apparatus (flush water tank apparatus), as described in Published Unexamined Patent Application H10-311073, so that electrical power is generated by the flow of supplied water, and the electromagnetic valve is operated by this electrical power. If electrical power is generated by the flow of water supplied to a flush water tank apparatus, and all the electrical power consumed by the electromagnetic valve can be supplied by the electrical power, then a flush water tank apparatus as described in Published Unexamined Patent Application 2009-257061 can be provided even in environments where no external power supply is available.

However, flush toilet apparatuses have become more water conserving in recent years, and the amount of water used for a single toilet flush has greatly diminished. Thus the amount of water supplied to a flush water tank apparatus with each toilet flush is small, so generating necessary electrical power with this small amount of water requires raising the flow speed, resulting in increased pressure losses in a generator. The force of supplied water weakens when pressure losses in the generator increase, therefore it may be anticipated that opening and closing discharge valves by a hydraulic cylinder apparatus as described in Published Unexamined Patent Application 2009-257061, would become impossible.

Therefore, one embodiment of the disclosure provides a flush water tank apparatus supplying flush water to a flush toilet by using electrical power generated in the flush water tank apparatus and flush toilet apparatus comprising the flush water tank apparatus.

The disclosed embodiment is a flush water tank apparatus supplying flush water to a flush toilet by using electrical power generated in the flush water tank apparatus, comprising a reservoir tank storing flush water supplied to the flush toilet, wherein a water discharge opening for discharging stored flush water to the flush toilet is formed in the reservoir tank; a discharge valve opening and closing the water discharge opening to supply and shut off flush water to the flush toilet; and a discharge valve hydraulic drive portion driving the discharge valve by utilizing a supply pressure of supplied tap water. The flush water tank apparatus further comprises a discharge control device supplying and shutting off water to the discharge valve hydraulic drive portion so that supplied tap water flows into the discharge valve hydraulic drive portion; an electromagnetic valve controlling to open and to close the discharge control device; a water supply valve supplying and shutting off water to the reservoir tank so that supplied tap water flows into the reservoir tank; a branching portion causing supplied tap water to divide so that one part divided flows into the discharge control device and the other part flows into the water supply valve; and a generator generating electrical power to operate the electromagnetic valve by using water flow. The generator is provided on a water conduit in a downstream side of the branching portion, and on the water conduit in an upstream side of the water supply valve or in a downstream side of the water supply valve.

In an embodiment thus constituted, a generator generates electrical power by water flow, and an electromagnetic valve is operated by using the electrical power. The electromagnetic valve controls the opening and closing of a discharge valve control device to supply and shut off the supply of water to a discharge valve hydraulic drive portion so that supplied tap water flows into the discharge valve hydraulic drive portion. The water supply valve supplies and shuts off water to the reservoir tank so that supplied tap water flows into the reservoir tank. Also, supplied tap water is divided in a branching portion, with one part divided flowing into the discharge control apparatus, and the other part flowing into the water supply valve. The generator is provided on a water conduit in a downstream side of the branching portion, and on the water conduit in an upstream side of the water supply valve or in a downstream side of the water supply valve.

According to an embodiment as constructed above, the generator is provided on a water conduit in the downstream side of the branching portion and on the water conduit in the upstream side of the water supply valve or in the downstream side of the water supply valve. Therefore the generator does not impart pressure losses to the flow of water supplied from a discharge control apparatus to a discharge valve hydraulic drive portion. Through research and development by the inventors, it has been proven that a discharge valve can be sufficiently driven by a discharge valve hydraulic drive portion by disposing the generator in this manner. This enables the provision of a flush water tank apparatus supplying flush water to a flush toilet by using electrical power generated in the flush water tank apparatus.

The disclosed embodiment is a flush toilet apparatus, wherein the flush toilet apparatus comprises the flush water tank apparatus of an embodiment disclosed, and a flush toilet flushed by flush water supplied from the flush water tank apparatus.

According to the flush water tank apparatus of an embodiment disclosed and a flush toilet apparatus comprising the flush water tank apparatus, it is possible to supply flush water to the flush toilet by using electrical power generated in the flush water tank apparatus.

DETAILED DESCRIPTION

Next, referring to the attached drawings, a flush toilet apparatus according to a first embodiment of the present disclosure is explained.

Figure 1:
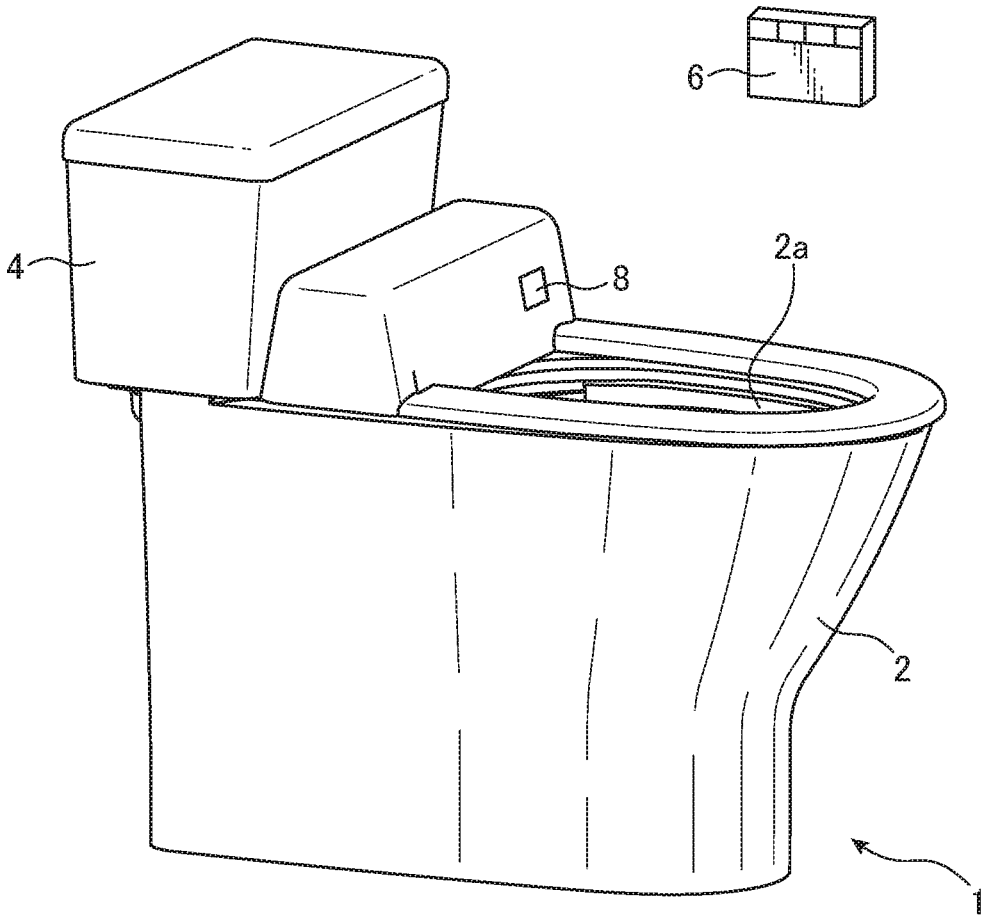
FIG. 1 is a perspective view showing a flush toilet apparatus comprising a flush water tank apparatus according to a first embodiment of the present disclosure.
Figure 2:
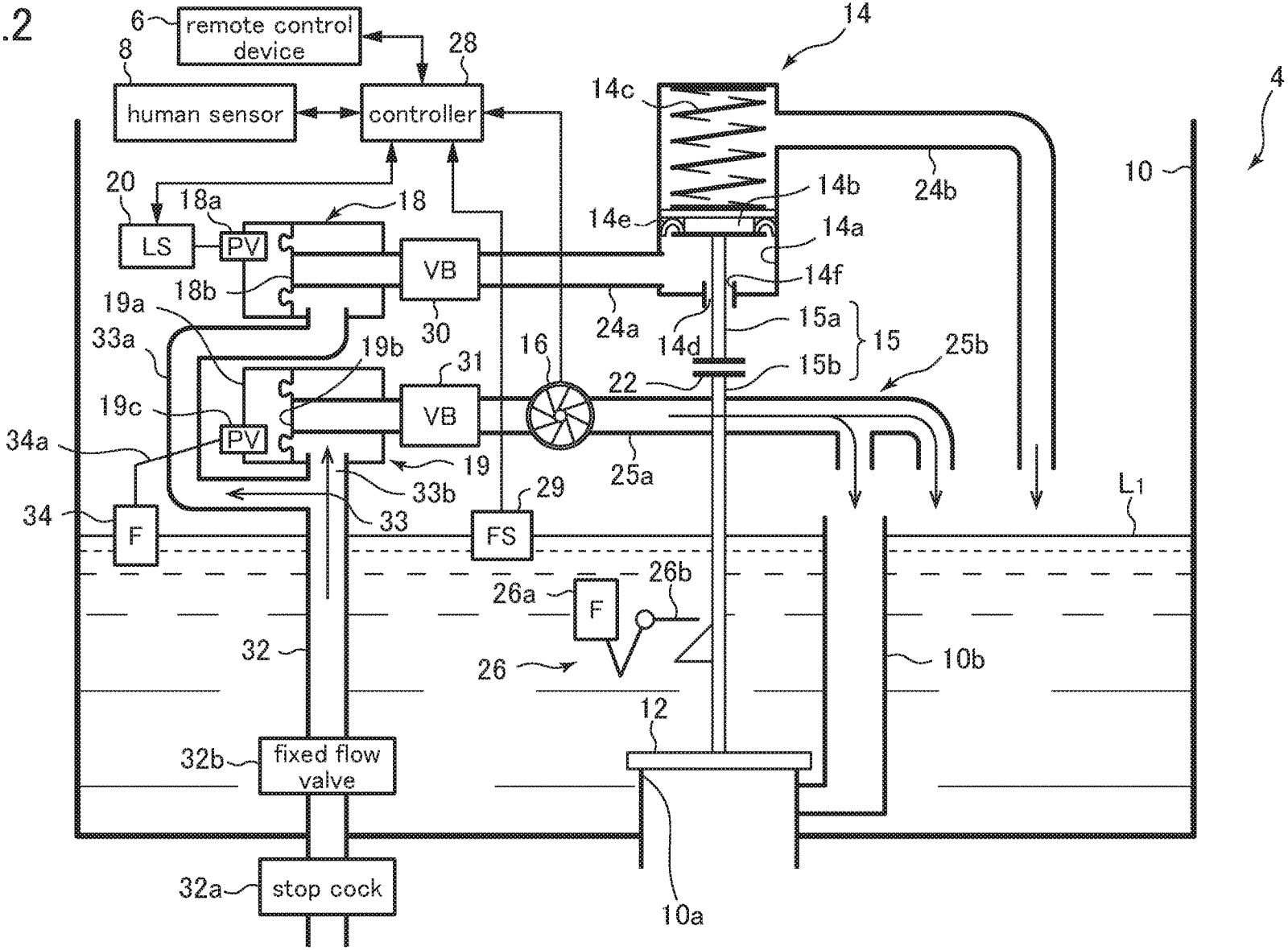
FIG. 2 is a cross sectional view showing the constitution of a flush water tank apparatus according to a first embodiment of the present disclosure.

FIG. 1 is a perspective view showing a flush toilet apparatus comprising a flush water tank apparatus according to a first embodiment of the present disclosure. FIG. 2 is a cross sectional view showing the constitution of a flush water tank apparatus according to a first embodiment of the present disclosure.

As shown in FIG. 1, a flush toilet apparatus 1 according to a first embodiment of the disclosure is constituted by a flush toilet main unit 2 being a flush toilet, and a flush water tank apparatus 4 according to an embodiment of the disclosure, mounted at the rear portion of this flush toilet main unit 2. The flush toilet apparatus 1 of the present embodiment is constituted so that flushing of the bowl portion 2*a* of the flush toilet main unit 2 is brought about either by operation of a remote control device 6 attached to the wall after a user uses the flush toilet apparatus, or by the elapse of a predetermined time after a human sensor 8 positioned on the toilet seat senses that the user has separated from the toilet seat. The flush water tank apparatus 4 according to the present embodiment is constituted so that flush water stored within is discharged to the flush toilet main unit 2 based on a command signal from the remote control device 6 or the human sensor 8, thereby flushing the bowl portion 2*a* with this flush water. Although in the present embodiment the human sensor 8 is positioned on the toilet seat, the disclosure is not limited to this form, and the sensor may be placed in a position where a user's sitting on or separation from the seat, approach or departure, or hand swiping action can be sensed, for example the sensor may be placed on the flush toilet main unit 2 or the flush water tank apparatus 4. It is sufficient for human sensor 8 to be capable of detecting a user's sitting on or leaving a seat, or approach or leaving, or hand swiping action. For example, an infrared sensor or microwave sensor may be used as the human sensor 8.

As shown in FIG. 2, flush water tank apparatus 4 comprises the reservoir tank 10 for storing flush water to be supplied to the flush toilet main unit 2, a discharge valve 12 for opening and closing a water discharge opening 10*a* disposed on this reservoir tank 10, and the discharge valve hydraulic drive portion 14 for driving this discharge valve 12. In addition, the flush water tank apparatus 4 comprises a discharge control device 18 primarily controlling the supply of water to the discharge valve hydraulic drive portion 14, and an electromagnetic valve 20 attached to the discharge control device 18. The flush water tank apparatus 4 comprises a water supply control valve 19 being a water supply valve primarily controlling the supply of water to the reservoir tank 10. As described below, the electromagnetic valve 20 operates by electrical power generated by the generator 16 using the flow of water out of the water supply control valve 19. The generator 16, the discharge valve hydraulic drive portion 14, the water supply control device 18, the water supply control valve 19 and the electromagnetic valve 20 are located inside the reservoir tank 10.

The reservoir tank 10 is a tank constituted to store flush water for supply to the flush toilet main unit 2. At the bottom portion of the reservoir tank 10 a water discharge opening 10*a* is formed for discharging stored flush water to the flush toilet main unit 2. Within the reservoir tank 10, an overflow pipe 10*b* is connected on the downstream side of the water discharge opening 10*a*. This overflow pipe 10*b* rises vertically near the water discharge opening 10*a* and extends above a water surface of the flush water stored in the reservoir tank 10. Therefore flush water flowing in from the top end of the overflow pipe 10*b* bypasses the water discharge opening 10*a* and flows directly out to the flush toilet main unit 2.

The discharge valve 12 is a valve body disposed so as to open and close water discharge opening 10*a*. The discharge valve 12 is opened when the discharge valve 12 is pulled up vertically by the discharge valve hydraulic drive portion 14, and flush water in the reservoir tank 10 is discharged to the flush toilet main unit 2, thereby the flushing bowl portion 2*a* is washed. The discharge valve 12 operates vertically within a casing (not shown).

The discharge valve hydraulic drive portion 14 is constituted to drive the discharge valve 12 by utilizing the supply water pressure of flush water supplied from a municipal water supply. Specifically, the discharge valve hydraulic drive portion 14 comprises a cylinder 14*a* into which water supplied from the discharge control device 18 flows, a piston 14*b* slidably disposed within this cylinder 14*a*, and a rod 15 projecting from the bottom end of the cylinder 14*a* to drive the discharge valve 12. In addition, a spring 14*c* is disposed on the interior of the cylinder 14*a*. The spring 14*c* the biases piston 14*b* downward, and a packing 14*e* is attached to the piston 14*b* to secure watertightness between the interior wall surface of the cylinder 14*a* and the piston 14*b*. A clutch mechanism 22 is disposed at a midway in the rod 15. The rod 15 is separated into an upper rod 15*a* and a lower rod 15*b* by means of this clutch mechanism 22.

The cylinder 14*a* is a cylindrical member. The axial line of the cylinder is disposed toward the vertical direction, and the piston 14*b* is slidably received on the interior of the cylinder. The cylinder 14*a* is mounted on the casing (not shown) of the discharge valve 12. An inflow pipe 24*a* is attached at the bottom end portion of the cylinder 14*a*, and water flowing out from the discharge control device 18 flows into the cylinder 14*a*. Therefore the piston 14*b* inside the cylinder 14*a* is pushed up in opposition to the biasing force of the spring 14*c* by water flowing into the cylinder 14*a*.

At the same time, an outflow hole is disposed on the top end portion of the cylinder 14*a*, and the outflow pipe 24*b* communicates with the interior of the cylinder 14*a* through the outflow hole. Therefore when water flows into the cylinder 14*a* from the inflow pipe 24*a* connected to the bottom portion of the cylinder 14*a*, the piston 14*b* is pushed up from the bottom portion of the cylinder 14*a*, which is at a first position. When the piston 14*b* is pushed up to a second position above the outflow hole, water which has flowed into the cylinder 14*a* flows out from the outflow hole through the outflow pipe 24*b*. That is, the inflow pipe 24*a* and the outflow pipe 24*b* communicate through the interior of the cylinder 14*a* when the piston 14*b* is moved to a second position. The outflow pipe 24*b* extends downward from the cylinder 14*a* and releases water into the reservoir tank 10. Therefore the entire amount of water flowing out of the cylinder 14*a* is stored in the reservoir tank 10.

The rod 15 is a rod-shaped member connected to the undersurface of the piston 14*b*. The rod 15 passes through a through-hole 14*f* formed on the bottom of the cylinder 14*a*, and extends so as to project downward from the inside of the cylinder 14*a*. The discharge valve 12 is connected to the bottom end of the rod 15, and the rod 15 links the piston 14*b* and the discharge valve 12. Therefore when water flows into the cylinder 14*a* water pushes the piston 14*b* up, the rod 15 connected to the piston 14*b* pulls the discharge valve 12 upward, and the discharge valve 12 is opened.

A gap 14*d* is disposed between the rod 15 projecting from the lower portion of the cylinder 14*a* and the inside wall of a through-hole 14*f* in the cylinder 14*a*. A portion of water flowing into the cylinder 14*a* flows out from the gap 14*d*. Water flowing out from the gap 14*d* flows into the reservoir tank 10. Because this gap 14*d* is relatively narrow and flow path resistance is high, the pressure inside the cylinder 14*a* rises due to water flowing into the cylinder 14*a* from the inflow pipe 24*a*, such that the piston 14*b* is pushed up in opposition to the bias force of the spring 14*c*, even in a state in which water is flowing out from the gap 14*d*.

In addition, a clutch mechanism 22 is disposed at a midway in the rod 15. The clutch mechanism 22 is constituted to separate the rod 15 into an upper rod 15*a* and a lower rod 15*b* when the rod 15 (the discharge valve 12) is pulled up by a predetermined distance. When the clutch mechanism 22 is separated, the lower rod 15*b* ceases to interlock with a movement of the upper portion which include the piston 14*b* and upper rod 15*a*, and the lower rod 15*b* together with the discharge valve 12, drops due to gravity as The lower rod 15 resists buoyancy.

A discharge valve float mechanism 26 is disposed close to the discharge valve 12. This discharge valve float mechanism 26 is constituted so as to delay the closing the water discharge opening 10*a* by descending the lower rod 15*b* and the discharge valve 12 after the rod 15 is pulled up by a predetermined distance and the lower rod 15*b* is separated by the clutch mechanism 22. Specifically, the discharge valve float mechanism 26 comprises a float portion 26*a* and a latching portion 26*b* that moves in association with a movement of the float portion 26*a*.

The latching portion 26 is constructed to engage the lower rod 15*b*, which has been separated by the clutch mechanism 22 and has dropped, so as to stop the lower rod 15*b* and the discharge valve 12 from dropping and seating on the water discharge opening 10*a*. Next, the float portion 26*a* drops with falling water level inside the reservoir tank 10, and when the water level inside the reservoir tank 10 falls to a predetermined water level, the float portion 26*a* causes the latching portion 26*b* to rotate, and the engagement between the latching portion 26*b* and the lower rod 15*b* is released. Release of the engagement allows the lower rod 15*b* and the discharge valve 12 to descend and seat on the water discharge opening 10*a*. Therefore, the closing of the discharge valve 12 is delayed, and an appropriate amount of flush water is discharged from the water discharge opening 10*a*.

A vacuum breaker 30 is provided on the inflow pipe 24*a* between the discharge control device 18 and the discharge valve hydraulic drive portion 14. When the pressure in a side of the discharge control device 18 becomes negative, this vacuum breaker 30 causes outside air to be drawn into the inflow pipe 24*a*, preventing a reverse flow of water from a side of the discharge valve hydraulic drive portion 14.

Next, the discharge control device 18 controls the supply of water to the discharge valve hydraulic drive portion 14 based on the operation of the electromagnetic valve 20, and controls a start and a stop of a supply of water to the reservoir tank 10. That is, The discharge control device 18 is connected tap water to the first branch pipe 33*a* branched in the water supply pipe branching portion 33 being a branching portion from the water supply pipe 32 connected to a tap water. The discharge control device 18 controls the start and the stop of a supply of water from the first branch pipe 33*a* to the discharge valve hydraulic drive portion 14 based on command signals from the controller 28. In the present embodiment, the entire amount of water flowing out from the discharge control device 18 passes through the inflow pipe 24*a* to be supplied to the discharge valve hydraulic drive portion 14. A portion of the water supplied to the discharge valve hydraulic drive portion 14 flows out from the gap 14*d* between the inside wall of the through-hole 14*f* of the cylinder 14*a* and the rod 15, then flows into the reservoir tank 10. Most of the water supplied to the discharge valve hydraulic drive portion 14 passes through the outflow pipe 24*b* and flows out from the cylinder 14*a* and into the reservoir tank 10.

In the present embodiment a circuit board and a capacitor (neither shown) are built in the controller 28. A rectifier circuit for converting AC from the generator 16 into DC is disposed on this circuit board; the capacitor is charged by DC current from the rectifier circuit, and an electromagnetic valve control circuit disposed on the circuit board is activated by power from the capacitor.

Water supplied from a tap water supply is supplied through a stop cock 32*a* disposed on the outside of the reservoir tank 10, and through a fixed flow valve 32*b* disposed within the reservoir tank 10 on the downstream side of the stop cock 32*a*, and reached to the water supply pipe branching portion 33. The water is supplied to the discharge control device 18 from a first branch pipe 33*a*, divided in the water supply pipe branching portion 33. The stop cock 32*a* is provided to shut off the supply of water to the flush water tank apparatus 4 during maintenance or the like, and is normally used in an open-valve state. The fixed flow valve 32*b* is provided to cause municipally supplied water to flow into the discharge control device 18 at a predetermined flow rate, and is constituted so that a constant flow volume of water is supplied to the discharge control device 18 regardless of the installation environment of the flush toilet apparatus 1.

An electromagnetic valve 20 is attached to the discharge control device 18, and the supply of water from the discharge control device 18 to the discharge valve hydraulic drive portion 14 is controlled based on the operation of the electromagnetic valve 20. Specifically, the controller 28 receives a signal from the remote control device 6 or the human sensor 8, and the controller 28 sends an electrical signal to the electromagnetic valve 20, thus activating it. The electromagnetic valve 20 is operated by electrical power produced by the generator 16 and stored in a capacitor (not shown) built into the controller 28.

That is, the electromagnetic valve 20 is constructed such that an electromagnetic valve-side pilot valve 18*a* built into the discharge control device 18 is moved based on a signal sent from the controller 28 to open or close the pilot valve opening on the main valve body 18*b* of the discharge control device 18. Thereby, discharge control device the main valve body 18*b* of the discharge control device 18 is opened and closed based on the operation of the electromagnetic valve 20 so as to control the start and the stop of a supply of water to the discharge valve hydraulic drive portion 14. In the present embodiment a bi-stable latching solenoid is used as the electromagnetic valve 20, which is temporarily energized to move the electromagnetic valve-side pilot valve 18*a*, after which the state at the turning off is maintained even when power is turned off. In the electromagnetic valve 20 of this type, the electromagnetic valve-side pilot valve 18*a* can be restored to its original position by again applying energy in the opposite direction.

Meanwhile a second branched pipe 33*b* branched in the water supply pipe branching portion 33 is connected to the water supply control valve 19, and generator 16 is provided on the downstream side of the water supply control valve 19, which is on the downstream side of the water supply pipe branching portion 33.

The water supply control valve 19 is constituted so that water supplied from the second branched pipe 33*b* is flowed out to a tank supply pipe 25*a*. Water which has flowed into the tank supply pipe 25*a* passes through the generator 16, then is divided in two in a tank supply pipe branching portion 25*b* being a second branching portion. One part divided flows out into the reservoir tank 10, and the other part flows out into the overflow pipe 10*b*. A vacuum breaker 31 is provided between the water supply control valve 19 and the generator 16. A reverse flow of water from the side of the tank supply pipe 25*a* into the water supply pipe 32 when pressure in the second branched pipe 33*b* turns negative can thus be prevented. In the present embodiment, the tank supply pipe 25*a* is constituted by a flexible pipe or the like, is easy to vibrate. with the rotation of the water wheel (not shown) built into the generator 16. This structure thus enables air to be more easily discharged by vibration even if air is incorporated into the tank supply pipe 25*a*, the tank supply pipe 25*a* is constructed that it is not easy to accumulate air inside the tank supply pipe 25*a*.

The supply control valve 19 comprises a water supply valve main body portion 19*a*, and a main valve body 19*b* disposed in the water supply valve main body portion 19*a*, and a float-side pilot valve 19*c*. A water supply valve float 34 is connected to the water supply control valve 19, whereby the water supply control valve 19 is constructed that the float-side pilot valve 19*c* moves in response to a movement of the water supply valve float 34. The, the float-side pilot valve 19*c* is constituted so as to control the pressure in the pressure chamber provided in the water supply valve main body portion 19*a* by opening and closing a pilot valve opening (not shown) disposed in the water supply valve main body portion 19*a*.

The water supply valve float 34 is disposed within the reservoir tank 10. The water supply valve float 34 rises together with the rise of the water level in the reservoir tank 10, and the water supply valve float 34 moves the float-side pilot valve 19*c* through an arm portion 34*a*. When the water level in the reservoir tank 10 has risen to predetermined water level $L_1$, the float-side pilot valve 19*c* causes the pilot valve opening (not shown) in the supply valve main body portion 19*a* to close. When the pilot valve opening is closed, pressure in the pressure chamber in the water supply valve main body portion 19*a* rises, the main valve body 19*b* is moved, and the water supply control valve 19 is closed.

Meanwhile, the generator 16 is placed at a midway in tank supply pipe 25*a* in the downstream side of the water supply control valve 19 and the vacuum breaker 31. The generator 16 is constructed to generate electrical power based on the flow of water. Electrical power produced by the generator 16 is sent to the controller 28 connected to the generator 16, and charged into a capacitor (not shown) built in the controller 28. In addition, a float switch 29, being a water level detection device is connected to the controller 28. The float switch 29 is disposed inside the reservoir tank 10, and detects an event that the water level in the reservoir tank 10 is lowered by a predetermined distance from the predetermined water level $L_1$.

Next the operation of a flush water tank apparatus 4 according to a first embodiment of the disclosure and a flush toilet apparatus comprising the flush water tank apparatus 4 is explained.

First, in the toilet flush standby state, the water level in the reservoir tank 10 is at predetermined water level $L_1$, and the electromagnetic valve 20 is not energized. In this state, the pilot valve opening on the main valve body 18*b* of the discharge control device 18 is in a closed state, and the discharge control device 18 is closed. The pilot valve opening is on the main valve body 19*b* of the water supply control valve 19 in a closed state, and the water supply control valve 19 is also closed. Next, when a user presses the flush button on the remote control device 6 (FIG. 1), the remote control device 6 transmits a toilet flush command signal to the controller 28 (FIG. 2). In the flush toilet apparatus 1 of the present embodiment, a toilet flush command signal is transmitted to the controller 28 even if a predetermined time has elapsed after the human sensor 8 (FIG. 1) detects that a user has separated from the seat, without the flush button of the remote control device 6 being pressed.

When the controller 28 receive the toilet flush command signal, the controller 28 energizes the electromagnetic valve 20 and causes the electromagnetic valve-side pilot valve 18*a* to separate from the pilot valve opening of the main valve body 18*b*. Pressure in the pressure chamber of the discharge control device 18 thus drops, and the main valve body 18*b* is unseated from the valve seat so that it is opened. In the present embodiment, a bi-stable latching solenoid is used as the electromagnetic valve 20. Therefore after once the electromagnetic valve-side pilot valve 18*a* has been opened, its open state is maintained even if power to the electromagnetic valve 20 is turned off. When the discharge control device 18 is opened, tap water is supplied to discharge control device from the water supply pipe 32 through the water supply pipe branching portion 33 and the first branch pipe 33*a* to the discharge control device 18. The tap water flows through the discharge control device 18 and into the inflow pipe 24*a*.

In addition, water flowing into inflow pipe 24*a* flows into the interior of the cylinder 14*a* in the discharge valve hydraulic drive portion 14, and pushes up the piston 14*b*. This causes the rod 15 and the discharge valve 12 linked to the piston 14*b* to be pulled up, so that the water discharge opening 10*a* is opened and the bowl portion 2*a* of the flush toilet main unit 2 is flushed.

When water flows from the inflow pipe 24*a* into the cylinder 14*a* of the discharge valve hydraulic drive portion 14 and the piston 14*b* is pushed up to the upper portion in the cylinder 14*a*, the water in the cylinder 14*a* flows out through the outflow pipe 24*b*. Water flowing out through the outflow pipe 24*b* flows into the reservoir tank 10. A portion of water flowing into the cylinder 14*a* from the inflow pipe 24*a* flows out from the gap 14*d* between the inner wall of the through-hole 14*f* of the cylinder 14*a* and the rod 15. This water then flows into the reservoir tank 10.

In addition, the water level in the reservoir tank 10 drops below a predetermined water level $L_1$ when flush water in the reservoir tank 10 is discharged, therefore the water supply valve float 34 descends. This causes the arm portion 34*a* to rotate so that the float-side pilot valve 19*c* separates from the pilot valve opening on the main valve body 19*b*, and opens the pilot valve opening. As a result, pressure in the pressure chamber within the water supply valve main body portion 19*a* of the water supply control valve 19 drops, and the main valve body 19*b* separates from the valve seat. When the water supply control valve 19 is opened, tap water supplied from the water supply pipe 32 through the water supply pipe branching portion 33 and to the water supply control valve 19 via the water supply pipe branching portion 33 flows through the water supply control valve 19 and into the tank supply pipe 25*a*. Water flowing into the tank supply pipe 25*a* causes a water wheel (not shown) in the generator 16 to rotate, thereby generating electrical power. The generated electrical power charges a capacitor (not shown) built into controller 28. Water which has passed through the generator 16 is divided in the tank supply pipe branching portion 25*b*. One part branched flows into the overflow pipe 10*b*, while the remainder of flow flows into the reservoir tank 10.

On the other hand, when it is detected by the float switch 29 that the water level in the reservoir tank 10 has dropped to a predetermined water level $L_2$, which is lower than predetermined water level $L_1$ by a predetermined distance, the float switch 29 transmits a signal to the controller 28 that the water level in the reservoir tank 10 has dropped. When it is detected that the water level in the reservoir tank 10 has dropped, the controller 28 energizes the electromagnetic valve 20, and causes the electromagnetic valve-side pilot valve 18*a* to seat on the pilot valve opening in the main valve body 18*b*. Pressure in the pressure chamber of the discharge control device 18 thus rises, such that the main valve body 18*b* seats on the valve seat and is closed. After the discharge valve 12 is thus opened, the discharge control device 18 shuts off the supply of water to the discharge valve hydraulic drive portion 14 before the water supply control valve 19 is closed.

That is, in the present embodiment a bistable latching solenoid is used as the electromagnetic valve 20, therefore the electromagnetic valve-side pilot valve 18*a* can be closed by energizing the electromagnetic valve 20 with the electromagnetic valve-side pilot valve 18*a* being in an open state. When the discharge control device 18 is closed, the supply of water to the discharge valve hydraulic drive portion 14 is stopped, and thereafter the entire amount of tap water supplied from the water supply pipe 32 passes through the water supply control valve 19 to be supplied into the reservoir tank 10 and utilized for electrical generation by generator 16. When the float switch 29 detects that the water level in the reservoir tank 10 has descended to the predetermined water level $L_2$, the controller 28 closes the discharge control device 18. In contrast, as a variant example the disclosure may be constituted so that discharge control device the discharge control device 18 is closed after elapse of a predetermined time after the controller 28 opens the discharge control device 18.

Meanwhile, in the discharge valve hydraulic drive portion 14, when the piston 14*b* is pushed up, and thereby the lower rod 15*b* and the discharge valve 12 are pulled up to the predetermined position, the clutch mechanism 22 separates lower rod 15*b* and the discharge valve 12 from the upper rod 15*a*. Thus while the discharge control device 18 is open, the upper rod 15*a* remains pushed and upward together with the piston 14*b*, while the lower rod 15*b* and the discharge valve 12 descend by their own weight. However the separated lower rod 15*b* engages with the latching portion 26*b* of the discharge valve float mechanism 26, and the descent of lower rod 15*b* and the discharge valve 12 are stopped. Thus after discharge control device 18 is closed, the water discharge opening 10*a* in the reservoir tank 10 remains in the opened state, and discharge from the reservoir tank 10 is continued.

Here, when the water level inside the reservoir tank 10 drops to a third predetermined water level $L_3$ lower than predetermined water levels $L_1$ and $L_2$, the float portion 26*a* of the discharge valve float mechanism 26 drops, the lowering causes the latching portion 26*b* to move. This results in a release of the engagement between the lower rod 15*b* and the latching portion 26*b*, so that the lower rod 15*b* and the discharge valve 12 again start to descend. The discharge valve 12 then causes the water discharge opening 10*a* of the reservoir tank 10 to close, and the discharge of flush water to the flush toilet main unit 2 is stopped. Since the discharge control device 18 and the water supply control valve 19 are in an open state even after the water discharge opening 10*a* is closed, water supplied from the water supply pipe 32 flows into the discharge valve hydraulic drive portion 14, then passes through the outflow pipe 24*b* to flow into reservoir tank. A portion of water passing through the water supply control valve 19 passes through the tank supply pipe 25*a* to flow into the reservoir tank 10, so the water level in the reservoir tank 10 rises.

When the water level in the reservoir tank 10 rises to the predetermined water level $L_1$, the water supply valve float 34 rises, the float-side pilot valve 19*c* is moved via the arm portion 34*a*, and the pilot valve opening is closed. This causes the pressure in the pressure chamber in the water supply valve main body portion 19*a* to rise, and the main valve body 19*b* is closed, so that the water supply control valve 19 is placed in a closed state. The supply of water to the reservoir tank 10 is thus shut off.

When the water supply control valve 19 is closed, the supply of water from the water supply control valve 19 to the generator 16 is stopped, and the generation of electrical power by generator 16 is ended. On the other hand when the supply of water to the discharge valve hydraulic drive portion 14 is stopped due to the closing of discharge control device 18, the piston 14*b* in the discharge valve hydraulic drive portion 14 is pushed down by the biasing force of the spring 14*c*. The upper rod 15*a* and the lower rod 15*b*, which had been separated by the clutch mechanism 22, are again joined when the upper rod 15*a* is pushed down together with the piston 14*b*. Therefore the next time a toilet flush is executed, the upper rod 15*a* and the lower rod 15*b* are both pulled up by the piston 14*b*. A single toilet flush is by this means completed, and the flush toilet apparatus is returned to a toilet flush standby state.

According to the flush water tank apparatus 4 of a first embodiment of the disclosure, the generator 16 is provided on a water conduit in the downstream side of the water supply pipe branching portion 33 and in the downstream side of the water supply control valve 19, therefore the generator 16 imparts no pressure losses to the flow of water supplied from discharge control device 18 to the discharge valve hydraulic drive portion 14. By such disposing the generator 16, the discharge valve 12 can be sufficiently driven by the discharge valve hydraulic drive portion 14. This enables the provision of the flush water tank apparatus 4 supplying flush water to the flush toilet main body 2 by using electrical power generated in the flush water tank apparatus.

Also, according to the flush water tank apparatus 4 of the present embodiment of the disclosure, the generator 16 is placed on the downstream side of the water supply control valve 19 and on further upstream side than the tank supply pipe branching portion 25*b*. Therefore electricity can be generated by using water flowing respectively into the reservoir tank 10 and the flush toilet main unit 2, and the discharge valve hydraulic drive portion 14 is reliably operated and a sufficient quantity of electric generation can be secured.

According to the flush water tank apparatus 4 of the present embodiment, water flowing out from the water supply control valve 19 is guided through the tank supply pipe 25*a* constituted by a flexible pipe, to the generator 16. Therefore the tank supply pipe 25*a* can easily vibrate during use of the flush water tank apparatus 4 so that internally accumulated air can be effectively discharged. A reduction in generating efficiency in the generator 16 can thus be prevented.

Also, according to the flush water tank apparatus 4 of the present embodiment, the supply of water to the discharge valve hydraulic drive portion 14 is stopped after the discharge valve 12 is opened. Therefore the entire amount of water supplied to the flush water tank apparatus 4 passes through the generator 16 after the discharge valve 12 is opened, and can thus be used for generating electricity. Thus, a sufficient quantity of electricity can be secured while the discharge valve is reliably opened by the discharge valve hydraulic drive portion 14.

In addition, according to the flush water tank apparatus 4 of the present embodiment, the discharge control device 18 is closed when the float switch 29 detects a predetermined water level. Therefore the opening of the discharge valve 12 can be more reliably detected and the discharge control device 18 can be closed at the appropriate timing., Thus, a sufficient amount of electrical generation can be assured while the discharge valve 12 is reliably opened.

A first embodiment of the disclosure is explained above. Various changes may also be made to the above-described first embodiment. For example, the generator 16 is placed on a water conduit in the downstream side of the water supply control valve 19 in the above-described first embodiment, but the generator 16 may also be placed on a water conduit in the downstream side of the water supply pipe branching portion 33 and in the upstream side water conduit of the water supply control valve 19.

Also, according to the above-described first embodiment, electrical power generated by the generator 16 is stored in a capacitor built into the controller, but the present disclosure may also be constituted to store electrical power in a battery instead of a capacitor. In addition, in the above-described first embodiment the clutch mechanism 22 is provided between the piston and the discharge valve, but it is also possible to omit the clutch mechanism 22. In the above-described first embodiment, the piston 14*b* provided in the discharge valve hydraulic drive portion 14 is driven in the vertical direction, but the present disclosure may also be constituted so that, for example, the piston 14*b* is driven horizontally. In such cases a mechanism should be provided to convert the movement direction of the piston 14*a* to the direction in which the discharge valve 12 is driven. In addition, in the above-described first embodiment a gap is provided between the through-hole on the bottom surface of the cylinder 14*a* and the rod 15, but it is also possible to make a watertight seal between the through-hole 14*f* and the rod 15. The present disclosure may also be constituted so that the discharge valve 12 is driven by a mechanism rotated by supply water pressure. instead of the piston 14*b* of the discharge valve hydraulic drive portion 14.

In addition, according to the above-described first embodiment the water supply control valve 19 is arranged such that the main valve body 19*b* is opened and closed by the float-side pilot valve 19*c* driven by the water supply valve float 34, but the disclosure may also be constituted so that the main valve body 19*b* is directly opened and closed by an electromagnetic valve. In the above-described first embodiment, the water supply control valve 19 may be constituted to be opened and closed by an electromagnetic valve which is opened and closed in response to a detection signal from the float switch 29 instead of the water supply valve float 34. The present disclosure may also be constituted so that the water level inside the reservoir tank 10 is not detected by the float switch 29 but may be calculated based on the amount of electricity generated (generator rpm) by the generator 16. Moreover, a further generator may be provided on the outflow pipe 24*b* in addition to the generator 16 provided on the tank supply pipe 25*a*. This enables the amount of electrical generation to be increased without impeding the operation of the discharge valve hydraulic drive portion 14.

Figure 3:
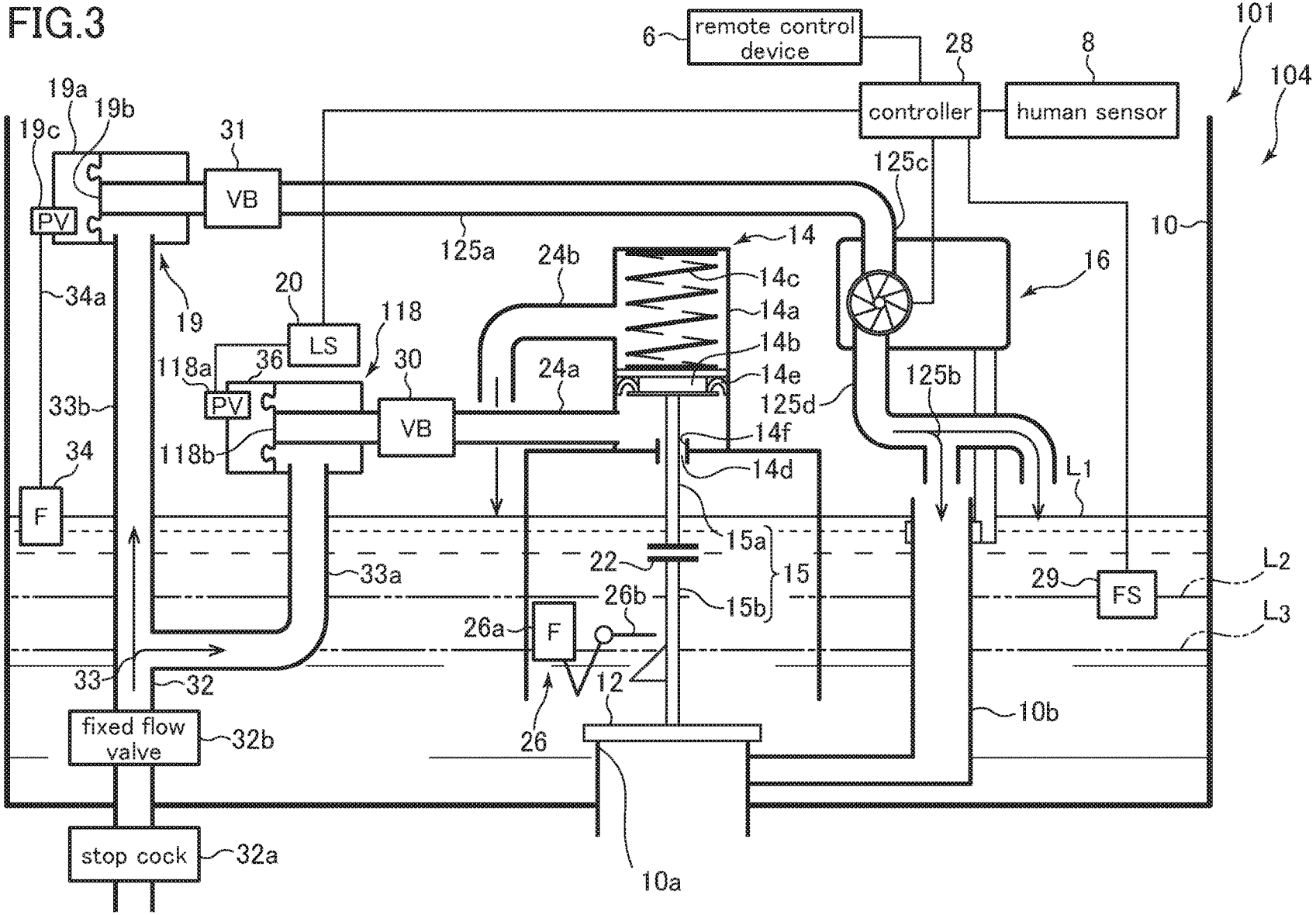
FIG. 3 is a cross sectional view showing the constitution of a flush water tank apparatus according to a second embodiment of the present disclosure.
Figure 4:
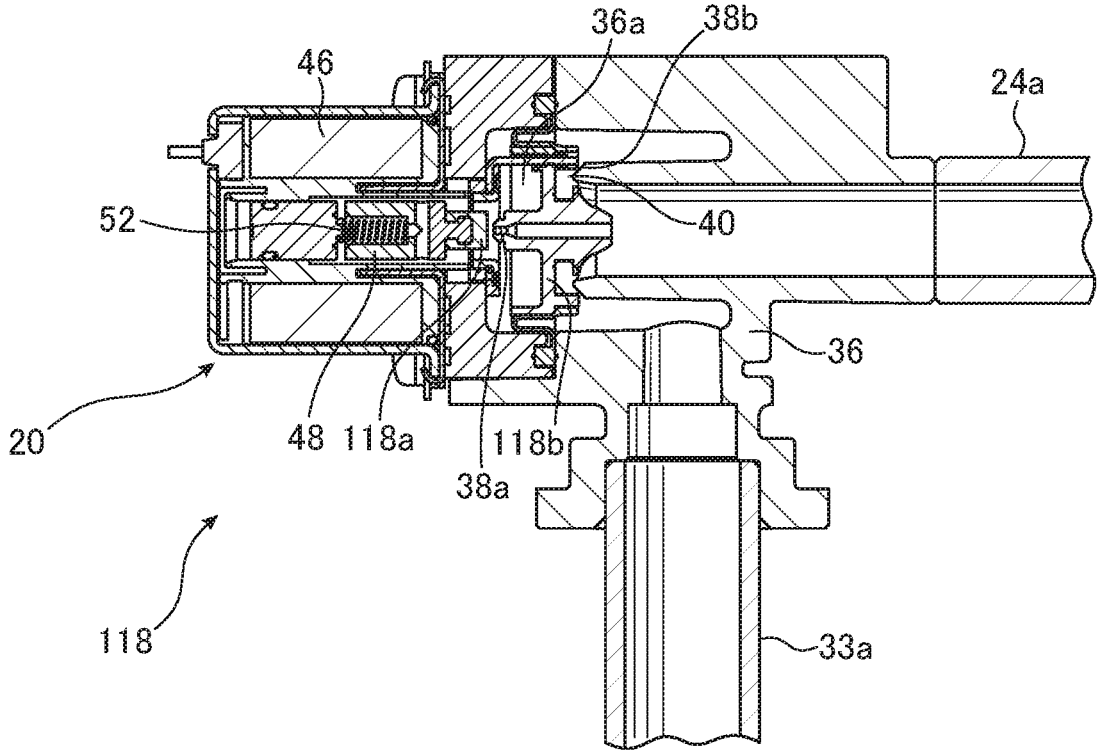
FIG. 4 is a cross sectional view showing a discharge control device provided in a flush water tank apparatus according to a second embodiment of the present disclosure.
Figure 5:
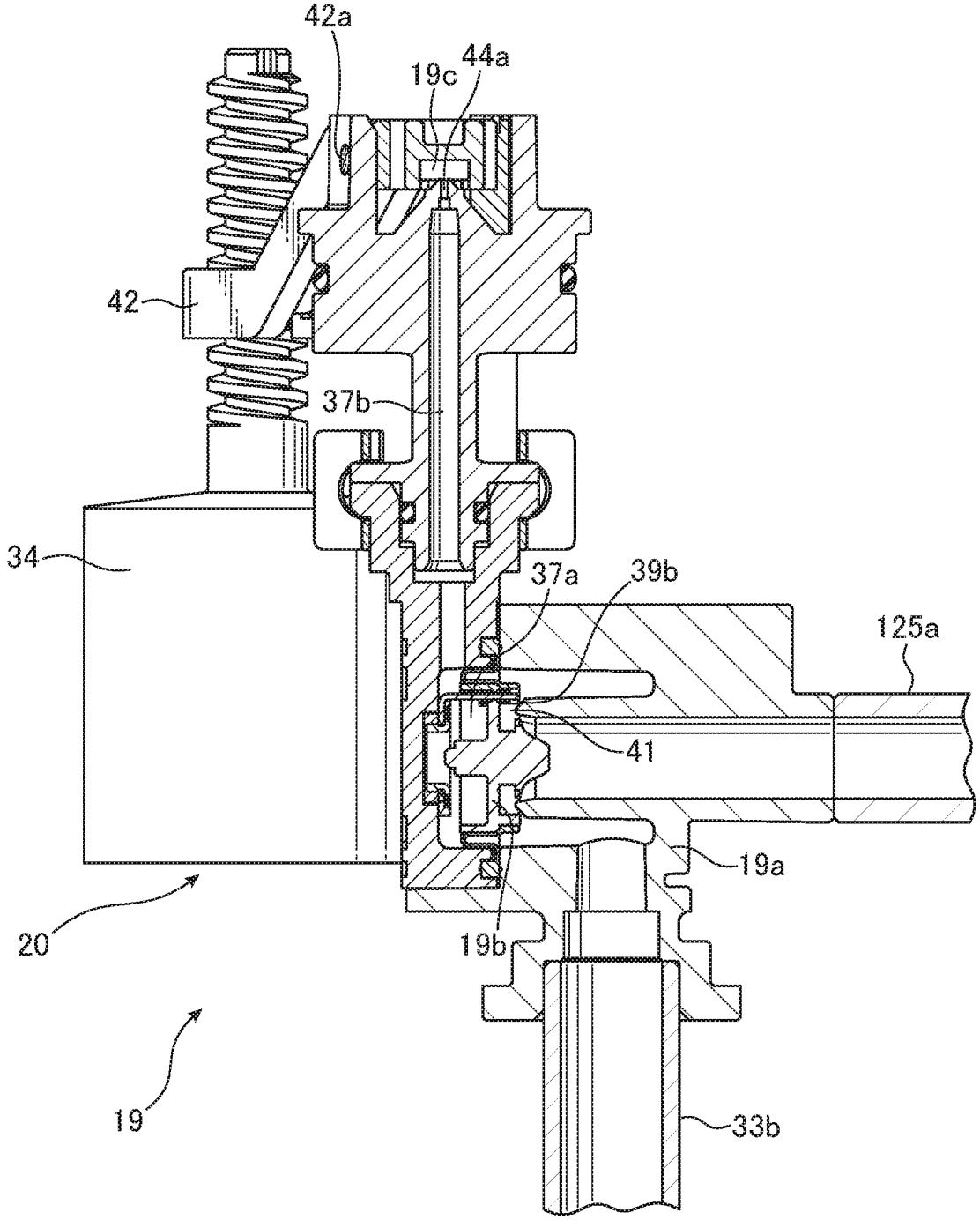
FIG. 5 is a cross sectional view showing a water supply control valve provided in a flush water tank apparatus according to a second embodiment of the present disclosure.
Figure 6:
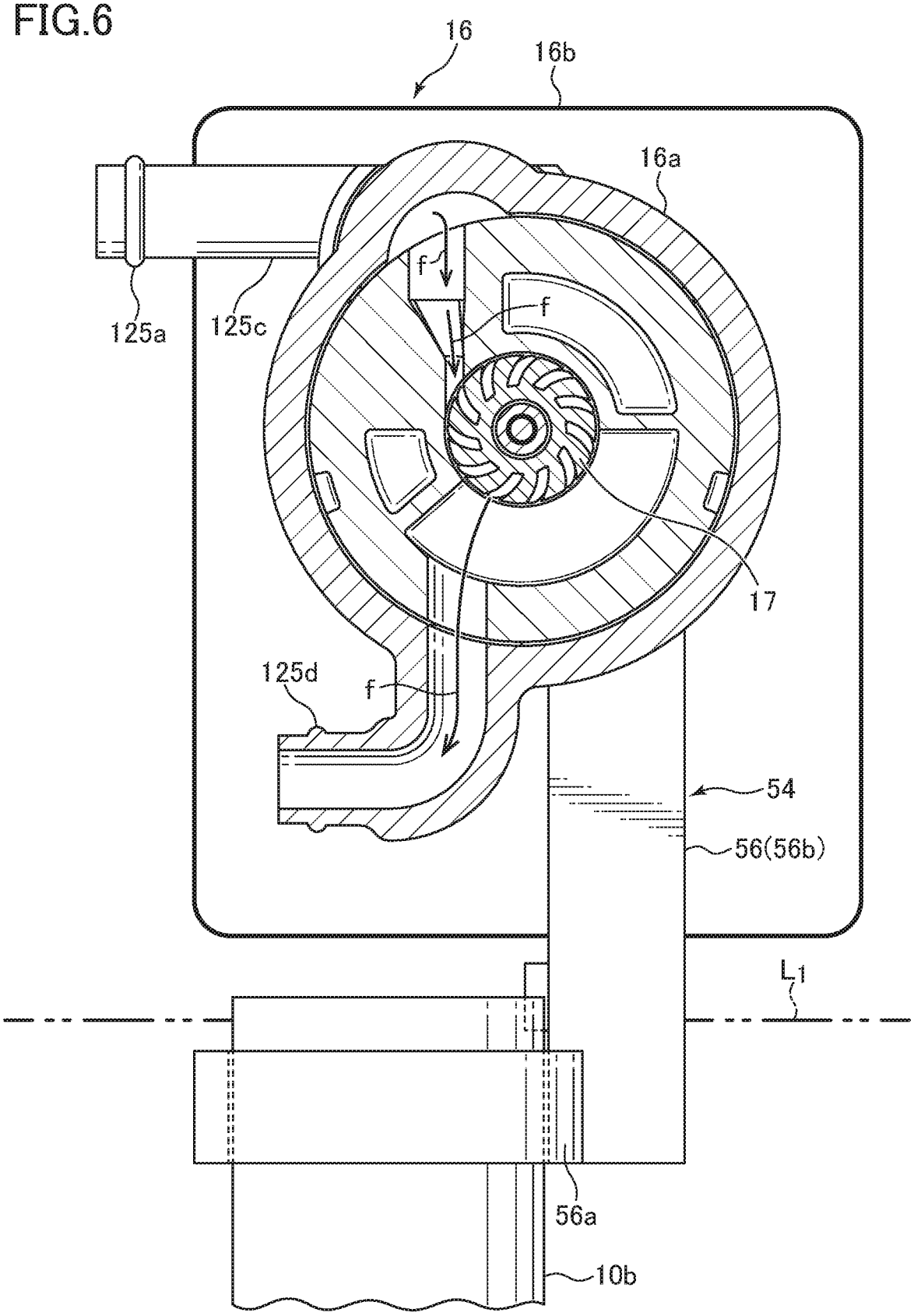
FIG. 6 is a cross sectional view showing a generator and a support member in a flush tank apparatus according to a second embodiment of the present disclosure.

Next, referring to FIGS. 3 through 6, a flush toilet apparatus according to a second embodiment of the disclosure is explained. The second embodiment is an example in which the generator 16 of the flush toilet apparatus according to the disclosure is disposed on a tank water supply pipe. FIG. 3 is a cross section showing the constitution of a flush water tank apparatus according to a second embodiment of the present disclosure. FIG. 4 is a cross section showing a discharge control device provided in a flush water tank apparatus according to a second embodiment of the present disclosure. FIG. 5 is a cross section showing a water supply control valve provided in a flush water tank apparatus according to a second embodiment of the present disclosure. FIG. 6 is a cross section showing a generator and support member in a flush tank apparatus according to a second embodiment of the present disclosure.

Since the flush toilet apparatus 101 according to the second embodiment has essentially the same constitution as the flush toilet apparatus according to the above-described first embodiment, only the points of difference between the second embodiment and first embodiment of the disclosure are explained, and the same reference numerals are assigned to the same portions in the drawings, and explanations thereof are omitted.

As shown in FIG. 3, a flush toilet apparatus 101 according to a second embodiment of the disclosure is constituted by a flush toilet main unit 2 (see FIG. 1) being a flush toilet, and a flush water tank apparatus 104 according to a second embodiment of the disclosure, mounted at the rear portion of this flush toilet main unit 2. The flush toilet apparatus 101 of the present embodiment is constituted so that flushing of the bowl portion 2*a* of the flush toilet main unit 2 is executed either by an operation of a remote control device 6 attached to the wall after a user uses the flush toilet apparatus 101, or by the elapse of a predetermined time after a human sensor 8 positioned on the toilet seat detects that a user has separated from the toilet seat. The flush water tank apparatus 104 according to the present embodiment is constituted so that flush water stored within it is discharged to the flush toilet main unit 2 based on a command signal from the remote control device 6 or the human sensor 8, and thereby the bowl portion 2*a* with this flush water is flushed. Hence, the flush toilet main unit 2 is flushed by flush water supplied from the flush water tank apparatus 104.

As shown in FIG. 3, the flush water tank apparatus 104 comprises the reservoir tank 10 for storing flush water to be supplied to the flush toilet main unit 2, the discharge valve 12 for opening and closing a water discharge opening 10*a* disposed on the reservoir tank 10, and the discharge valve hydraulic drive portion 14 for driving the discharge valve 12. Also, the flush water tank apparatus 104 comprises a discharge control device 118 primarily controlling the supply of water to the discharge valve hydraulic drive portion 14, and an electromagnetic valve 20 attached to the discharge control device 118. The flush water tank apparatus 104 comprises a water supply control valve 19 being a water supply valve primarily controlling the supply of water to the reservoir tank 10. As described below, the electromagnetic valve 20 operates by electrical power generated by generator 16 using the flow of water out of the water supply control valve 19. The generator 16, the discharge valve hydraulic drive portion 14, the discharge control device 118, the water supply control valve 19 and the electromagnetic valve 20 are located inside the reservoir tank 10. The flush water tank apparatus 104 supplies flush water to the flush toilet main unit 2 by using electrical power generated in the flush water tank apparatus.

The reservoir tank 10 is a tank constituted to store flush water for supply to the flush toilet main unit 2. At the bottom portion of the reservoir tank 10 a water discharge opening 10*a* is formed for discharging stored flush water to the flush toilet main unit 2. Within the reservoir tank 10, an overflow pipe 10*b* is connected on the downstream side of the water discharge opening 10*a*. This overflow pipe 10*b* rises vertically near the water discharge opening 10*a* and extends to further upward than the surface of the dead water level $L_1$ of the flush water stored in the reservoir tank 10. Therefore the overflow pipe 10*b* causes flush water flowed in from the overflow opening at the top end of the overflow pipe 10*b* to bypass the water discharge opening 10*a* and to flow out directly to the flush toilet main unit 2.

The discharge valve 12 is a valve body disposed so as to open and close the water discharge opening 10*a*. The discharge valve 12 is opened by being pulled up vertically by the discharge valve hydraulic drive portion 14, and flush water in the reservoir tank 10 is discharged to the flush toilet main unit 2 and thereby the bowl portion 2*a* is flushed. Hence the discharge valve 12 supplies and shuts off the supply of water to the flush toilet main unit 2. The discharge valve 12 operates vertically within a casing.

The discharge valve hydraulic drive portion 14 is constituted to drive the discharge valve 12 by utilizing the supply water pressure of municipally supplied flush water. Specifically, the discharge valve hydraulic drive portion 14 comprises a cylinder 14*a* into which water supplied from discharge control device 118 flows, a piston 14*b* slidably disposed within the cylinder 14*a*, and a rod 15 projecting from the bottom end of the cylinder 14*a* to drive the discharge valve 12. In addition, a spring 14*c* is disposed on the interior of the cylinder 14*a*. The spring 14*c* biases the piston 14*b* downward, and a packing 14*e* is attached to the piston 14*b* to secure watertightness between the interior wall surface of the cylinder 14*a* and the piston 14*b*. A clutch mechanism 22 is disposed at a midway in the rod 15. The rod 15 is separated into an upper rod 15*a* and a lower rod 15*b* by means of this clutch mechanism 22.

The cylinder 14*a* is a cylindrical member. The axial line of the cylinder is disposed toward the vertical direction, and the piston 14*b* is slidably received on the interior of the cylinder. The cylinder 14*a* is mounted on the casing of the discharge valve 12. An inflow pipe 24*a* is attached at the bottom end portion of the cylinder 14*a*, and water flowing out from the discharge control device 118 flows into the cylinder 14*a*. Therefore the piston 14*b* inside the cylinder 14*a* is pushed up in opposition to the biasing force of the spring 14*c* by water flowing into the cylinder 14*a*.

On the other hand, an outflow hole is disposed on the top end portion of the cylinder 14*a*, and the outflow pipe 24*b* communicates with the interior of the cylinder 14*a* through the outflow hole. Therefore when water flows into the cylinder 14*a* from the inflow pipe 24*a* connected to the bottom portion of the cylinder 14*a*, the piston 14*b* is pushed up from the bottom portion of the cylinder 14*a*, which is at a first position. When the piston 14*b* is pushed up to a second position above the outflow hole, water which has flowed into the cylinder 14*a* flows out from the outflow hole through the outflow pipe 24*b*. That is, the inflow pipe 24*a* and the outflow pipe 24*b* communicate through the interior of the cylinder 14*a* when the piston 14*b* is moved to a second position. The outflow pipe 24*b* extends downward from the cylinder 14*a* and releases water into the reservoir tank 10. Therefore the entire amount of the water flowing out of cylinder 14*a* is stored in the reservoir tank 10.

The rod 15 is a rod-shaped member connected to the undersurface of the piston 14*b*. The rod 15 passes through a through-hole 14*f* formed on the bottom of the cylinder 14*a*, and extends so as to project downward from the inside of the cylinder 14*a*. The discharge valve 12 is connected to the bottom end of the rod 15, and the rod 15 links the piston 14*b* and the discharge valve 12. Therefore when water flows into the cylinder 14*a*, water pushes the piston 14*b* up, the rod 15 connected to the piston 14*b* pulls the discharge valve 12 upward, and the discharge valve 12 is opened.

A gap 14*d* is disposed between the rod 15 projecting from the lower portion of the cylinder 14*a* and the inside wall of a through-hole 14*f* in the cylinder 14*a*. A portion of water flowing into the cylinder 14*a* flows out from the gap 14*d*. Water flowing out from the gap 14*d* flows into the reservoir tank 10. Because the gap 14*d* is relatively narrow and flow path resistance is high, the pressure inside the cylinder 14*a* rises due to water flowing into the cylinder 14*a* from the inflow pipe 24*a*, such that the piston 14*b* is pushed up in opposition to the bias force of the spring 14*c*, even in a state in which water is flowing out from the gap 14*d*.

In addition, a clutch mechanism 22 is disposed on a midway in the rod 15. The clutch mechanism 22 is constituted to separate the rod 15 into an upper rod 15*a* and a lower rod 15*b* when the rod 15 (the discharge valve 12) is pulled up by a predetermined distance. When clutch mechanism 22 is separated, the lower rod 15*b* ceases to interlock with a movement of the upper portion, which include the piston 14*b* and the upper rod 15*a*, and the lower rod 15*b*, together with the discharge valve 12, drops due to gravity as the lower rod 15*b* resists buoyancy.

A discharge valve float mechanism 26 is disposed close to the discharge valve 12. This discharge valve float mechanism 26 is constituted so as to delay the closing of the water discharge opening 10*a* by descending the lower rod 15*b* and the discharge valve 12 after the rod 15 is pulled up by a predetermined distance and the lower rod 15*b* is separated by the clutch mechanism 22. Specifically, the discharge valve float mechanism 26 comprises a float portion 26*a* and a latching portion 26*b* that moves in association with a movement of the float portion 26*a*.

The latching portion 26 is constructed to engage the lower rod 15*b*, which has been separated by the clutch mechanism 22 and has dropped, so as to stop the lower rod 15*b* and the discharge valve 12 from dropping and seating on water discharge opening 10*a*. Next, the float portion 26*a* lowers to the predetermined water level inside the reservoir tank 10, and when the water level inside the reservoir tank 10 falls to a predetermined water level, the float portion 26*a* causes the latching portion 26*b* to rotate, and the engagement between the latching portion 26*b* and the lower rod 15*b* is released. Release of the engagement allows the lower rod 15*b* and the discharge valve 12 to descend and seat on the water discharge opening 10*a*. Therefore, the closing of the discharge valve 12 is delayed, and an appropriate amount of flush water is discharged from the water discharge opening 10*a*.

A vacuum breaker 30 is provided on the inflow pipe 24*a* between the discharge control device 118 and the discharge valve hydraulic drive portion 14. When the pressure in the side of the discharge control device 118 becomes negative, this vacuum breaker 30 causes outside air to be drawn into the inflow pipe 24*a*, preventing a reverse flow of water from a side of the discharge valve hydraulic drive portion 14.

Next, the discharge control device 118 controls the supply of water to the discharge valve hydraulic drive portion 14 based on the operation of the electromagnetic valve 20, and controls a start and a stop of a supply of water to the reservoir tank 10. The discharge valve control device 118 supplies or shuts off water to the discharge valve hydraulic drive portion 14 so that supplied tap water flows into the discharge valve hydraulic drive portion 14. That is, the discharge control device 118 is connected tap water to the first branch pipe 33*a* branched in the water supply pipe branching portion 33 being a branching portion from the water supply pipe 32 connected to a tap water. The discharge control device 18 controls the start and the stop of a supply of water from the first branch pipe 33*a* to the discharge valve hydraulic drive portion 14 based on command signals from the controller 28. In the present embodiment, the entire amount of water flowing out from the discharge control device 118 passes through the inflow pipe 24*a* to be supplied to the discharge valve hydraulic drive portion 14. A portion of the water supplied to the discharge valve hydraulic drive portion 14 flows out from the gap 14*d* between the inside wall of the through-hole 14*f* of the cylinder 14*a* and the rod 15, then flows into the reservoir tank 10. Most of the water supplied to the discharge valve hydraulic drive portion 14 passes through the outflow pipe 24*b* and flows out from the cylinder 14*a* and into the reservoir tank 10.

In the present embodiment a circuit board and a capacitor (neither shown) are built in the controller 28. A rectifier circuit for converting AC from the generator 16 into DC is disposed on this circuit board; the capacitor is charged by DC current from the rectifier circuit, and an electromagnetic valve control circuit disposed on the circuit board is activated by power from the capacitor.

Water supplied from a municipal source is supplied through a stop cock 32*a* disposed on the outside of the reservoir tank 10, and through a fixed flow valve 32*b* disposed within the reservoir tank 10 in the downstream side of the stop cock 32*a*, and reached to the water supply pipe branching portion 33. The water is supplied to the discharge control device 118 from a first branch pipe 33*a* branched in the water supply pipe branching portion 33. The stop cock 32*a* is provided to shut off the supply of water to the flush water tank apparatus 104 during maintenance or the like, and is normally used in an open-valve state. The fixed flow valve 32*b* is provided to cause municipally supplied water to flow at a predetermined flow rate into the discharge control device 118 and/or the water supply control valve 19, and is constituted so that a constant flow rate of water is supplied to the discharge control device 118 and/or the water supply control valve 19 regardless of the installation environment of the flush toilet apparatus 101.

An electromagnetic valve 20 is attached to the discharge control device 118, and the supply of water from the discharge control device 118 to the discharge valve hydraulic drive portion 14 is controlled based on the operation of the electromagnetic valve 20. Specifically, the controller 28 receives a signal from the remote control device 6 or the human sensor 8, and the controller 28 sends an electrical signal to the electromagnetic valve 20, thus activating it. The electromagnetic valve 20 is operated by electrical power produced by the generator 16 and stored in a capacitor (not shown) built into the controller 28. The electromagnetic valve 20 controls the opening and closing of the discharge control device 118.

As shown in FIG. 4, the discharge control device 118 comprises a main body portion 36 to which the first branch pipe 33*a* and the inflow pipe 24*a* are attached, a main valve body 118*b* disposed within the main body portion 36, and a valve seat 40 on which the main valve body 118*b* seats.

Also, the electromagnetic valve 20 attached to the discharge control device 118 comprises a solenoid coil 46 generating drive power, a plunger 48 driven with the solenoid coil 46, an electromagnetic valve-side pilot valve 118*a* attached to this plunger 48, and a coil spring 52 for pressing the electromagnetic valve-side pilot valve 118*a* into the main valve body 118*b* when the valve is closed.

The main body portion 36 is a member which a connecting portion of the water supply pipe 32 is disposed on the bottom portion of the main body portion, and a connecting portion of the inflow pipe 24*a* is disposed on one side of the main body portion. The electromagnetic valve 20 is attached on the opposite side of the inflow pipe 24*a*. A valve seat 40 is formed in the inside of the main body portion 36. The valve seat 40 communicates with the inflow pipe 24*a*, which is connected to a connecting portion. In addition, a main valve body 118*b* is disposed in the interior of the main body portion 36 so as to open and close the valve seat 40, and is constituted so that when the valve is open, tap water flowing in from the water supply pipe 32 passes between the valve seat 40 and the main valve body 118*b* and flows out to the inflow pipe 24*a*.

The main valve body 118*b* is an approximately circular disk-shaped diaphragm-type valve body, attached to the inside of the main body portion 36 so as to be able to seat on and unseat from the valve seat 40. A pilot valve opening 38*a* opened and closed by the electromagnetic valve-side pilot valve 118*a* of the electromagnetic valve 20, is provided at the center of the main valve body 118*b*, and a bleed hole 38*b* is provided on the perimeter portion of the main valve body 118*b*. Also, in the main body portion 36, the pressure chamber 36*a* is formed in the opposite side of the valve seat 40 (the left side in FIG. 4) relative to the main valve body 118*b*. That is, the pressure chamber 36*a* is partitioned by the interior wall surface of the main body portion 36 and the main valve body 118*b*. Then pressure inside this pressure chamber 36*a* rises, the main valve body 118*b* is pressed into the valve seat 40 by the pressure and seated on the valve seat 40.

On the other hand, the electromagnetic valve 20 is attached to the main body portion 36 so as to face the valve seat 40, and is constituted to enable electromagnetic valve-side pilot valve 118*a* to advance and retract within the pressure chamber 36*a* in the main body portion 36. That is, the plunger 48 is slidably disposed in the center portion of the electromagnetic valve 20, and a solenoid coil 46 is provided around this plunger 48. An electromagnetic valve-side pilot valve 118*a* is attached to the end of the plunger 48; this electromagnetic valve-side pilot valve 118*a* is pressed into the pilot valve opening 38*a* of the main valve body 118*b* by the biasing force of the coil spring 52, and closes it. Thus the electromagnetic valve-side pilot valve 118*a* normally acts to close the pilot valve opening 38*a* by the biasing force of the coil spring 52. Meanwhile, when the solenoid coil 46 is energized, the electromagnetic valve-side pilot valve 118*a* is pulled away from the pilot valve opening 38*a* by the electromagnetic force acting between the solenoid coil 46 and the plunger 48, and the pilot valve opening 38*a* is opened.

During standby of the toilet flush, the water level inside the reservoir tank 10 is at dead water level $L_1$. The solenoid coil 46 of the electromagnetic valve 20 is not energized, and the pilot valve opening 38*a* in the main valve body 118*b* is in a closed state.

Tap water flowing into the main body portion 36 from the water supply pipe 32 flows into an annular-shaped space around the valve seat 40. The water flows from the space through the bleed hole 38*b* in the main valve body 118*b* and into the pressure chamber 36*a*. In the state in which the pilot valve opening 38*a* in the main valve body 118*b* is closed by the electromagnetic valve-side pilot valve 118*a*, there is no conduit for tap water flowed into the pressure chamber 36*a* from the bleed hole 38*b* to flow out, and the pressure in pressure chamber 36*a* rises. When the pressure in the pressure chamber 36*a* rises, the main valve body 118*b* is pressed in toward the valve seat 40 (toward the right side in FIG. 4), and the valve seat 40 is closed by the main valve body 118*b*. When the valve seat 40 is in a closed state during toilet flush standby, the pilot valve opening 38*a* in the main valve body 118*b* is closed by the biasing force of the coil spring 52, so no electrical power is consumed by the electromagnetic valve 20.

When the solenoid coil 46 in the electromagnetic valve 20 is energized, electromagnetic force acting on the plunger 48 causes the electromagnetic valve-side pilot valve 118*a* to separate from the pilot valve opening 38*a* so that water inside the pressure chamber 36*a* flows out from the pilot valve opening 38*a*, causing the pressure inside the pressure chamber 36*a* to drop. Main valve body 118*b* is thus moved so as to separate from the valve seat 40 (toward the left side in FIG. 4), such that the valve seat 40 is opened. Thus with the pilot valve opening 38*a* of the main valve body 118*b* in an opened state, the pressure inside the main body portion 36*a* does not rise, therefore the valve seat 40 is opened.

The electromagnetic valve-side pilot valve 118*a* built into the discharge control device 118 is moved based on a signal sent from the controller 28. The electromagnetic valve-side pilot valve 118*a* is constructed to open or close the pilot valve opening in the main valve body 118*b* of the discharge control device 118. By so doing, the main valve body 118*b* of the discharge control device 18 is opened and closed based on the operation of the electromagnetic valve 20 so as to control the supply and shutting off of water to the discharge valve hydraulic drive portion 14. In the present embodiment a bi-stable latching solenoid is used as the electromagnetic valve 20, which is temporarily energized to move the electromagnetic valve-side pilot valve 118*a*, after which that state is maintained even when power is turned off. In the electromagnetic valve 20 of this type, the electromagnetic valve-side pilot valve 118*a* can be returned to its original position by again applying electric power in the opposite direction.

Meanwhile, the second branched pipe 33*b*, branched in the water supply pipe branching portion 33, is connected to the water supply control valve 19, and the generator 16 is provided on a water conduit in the downstream side of the water supply pipe branching portion 33, and in the downstream side of the water supply control valve 19.

The water supply control valve 19 is constituted so that water supplied from second branched pipe 33*b* is made to flow out to a tank supply pipe 125*a*. Water which has flowed into the tank supply pipe 125*a* passes through the generator 16, then is divided in two in a tank supply pipe branching portion 125*b* being a second branching portion. One divided flows out into the reservoir tank 10, and the other flows out into the overflow pipe 10*b*. A vacuum breaker 31 is provided between the water supply control valve 19 and the generator 16. A reverse flow of water from the side of the tank supply pipe 125*a* into the water supply pipe 32 when the pressure in the side of the second branched pipe 33*b* turns negative can be prevented. In the present embodiment, the tank supply pipe 125*a* is constituted by a flexible pipe having a flexibility, and is easy to vibrate with the rotation of a water wheel (not shown) built into the generator 16. This structure thus enables air to be more easily discharged by vibration even if air is incorporated into the tank supply pipe 125*a*, the tank supply pipe 125*a* is constructed that it is not easy to accumulate air inside the tank supply pipe 125*a*. A reduction in generating efficiency by the generator 16 can thus be prevented.

A water supply valve float 34 is connected to the water supply control valve 19, and the reservoir water level in the reservoir tank 10 is set to a predetermined dead water level $L_1$. The water supply valve float 34 is disposed inside the reservoir tank 10, and is constituted to rise as the water level in the reservoir tank 10 rises. The supply of water from the water supply control device 19 to the generator 16 is shut off when the water level rises to a dead water level $L_1$. The water supply control valve 19 functions as a supply control device to control the supplying and shutting off of water to the reservoir tank 10 so that supplied tap water flows into the reservoir tank 10.

As shown in FIG. 5, the water supply control valve 19 comprises a main body portion 19*a* to which the second branched pipe 33*b* and the tank supply pipe 125*a* are connected, a main valve body 19*b* disposed in the main body portion 19*a*, a valve seat 41 on which the main valve body 19*b* seats, an arm portion 42 rotated by the water supply valve float 34, and a float-side pilot valve 19*c* moved by the rotation of the arm portion 42. In the valve open state, when the main valve body 19*b* opens the valve seat 41, tap water flowing in from the second branched pipe 33*b* passes between the valve seat 41 and the main valve body 19*b* to flow out to the tank supply pipe 125*a*.

The main valve body 19*b* is an approximately circular disk-shaped diaphragm-type valve body, attached to the inside of the main body portion 19*a* so as to be able to seat on and unseat from the valve seat 41. A bleed hole 39*b* is provided on the perimeter portion of the main valve body 19*b*. Inside the main body portion 19*a*, a pressure chamber 37*a* is formed on the opposite side of the valve seat 41 (on the left side in FIG. 5) relative to the main valve body 19*b*. That is, the pressure chamber 37*a* defined by the inside wall surface of the main body portion 19*a* and the main valve body 19*b*, and when the pressure inside pressure chamber 37*a* rises, the main valve body 19*b* is pressed into the valve seat 41 by the raised pressure, and seats on the valve seat 41.

In addition, a pressure conduit 37*b* extends upward so as to communicate with to the pressure chamber 37*a* disposed within the main body portion 19*a*, and a float-side pilot valve opening 44*a* is provided at the top end of the pressure conduit 37*b*. The float-side pilot valve opening 44*a* is open toward the upper portion, and is constituted to be opened and closed by the float-side pilot valve 19*c*.

At the same time, the water supply valve float 34 is supported by arm portion 42. The arm portion 42 is rotatably supported by a support shaft 42*a*. In addition, a float-side pilot valve 19*c* is connected to the arm portion 42, and the float-side pilot valve 19*c* is constituted to be moved up and down with the rotation of the arm portion 42. In a state in which the water level in the reservoir tank 10 has risen to the dead water level $L_1$, the water supply valve float 34 is pressed upward, and the float-side pilot valve 19*c* is moved downward, and seats on the float-side pilot valve opening 44*a*, thereby the float-side pilot valve opening 44*a* is closed. On the other hand when flush water in the reservoir tank 10 is discharged and the water level in the reservoir tank 10 drops, the water supply valve float 34 descends, and the float-side pilot valve 19*c* moves upward, and the float-side pilot valve opening 44*a* is opened. During toilet flush standby, the water level in the reservoir tank 10 is at dead water level $L_1$, and the float-side pilot valve opening 44*a* of the main body portion 36 is in a closed state.

Municipal water flowing into the main body portion 19*a* from the second branched pipe 33*b* flows into an annular-shaped space around the valve seat 41. The water flows from the space through the bleed hole 39*b* in the main valve body 19*b* and into the pressure chamber 37*a*. Here, in a state in which the float-side pilot valve opening 44*a* is closed by the float-side pilot valve 19*c*, tap water flowing into the pressure chamber 37*a* from the bleed hole 39*b* has no outflow pathway, so the pressure in pressure chamber 37*a* rises. When the pressure in the pressure chamber 37*a* thus rises, the main valve body 19*b* is pressed in toward the valve seat 41 (toward the right side in FIG. 5), and the valve seat 41 is closed by the main valve body 19*b*. When the valve seat 41 is closed during standby for a toilet flush, the float-side pilot valve opening 44*a* is closed by the buoyancy force of the water supply valve float 34.

On the other hand if the water level in the reservoir tank 10 has dropped to lower level than the dead water level $L_1$, the water supply valve float 34 drops, the float-side pilot valve 19*c* moves upward, and the float-side pilot valve opening 44*a* is opened. Thus with the float-side pilot valve opening 44*a* being in an opened state, the pressure inside the pressure chamber 37*a* does not rise, therefore the valve seat 41 is opened. Thus the float-side pilot valve 19*c* is constituted to control the pressure in the pressure chamber 37*a* by opening and closing the float-side pilot valve opening 44*a*.

Meanwhile, the generator 16 is placed at a midway in the tank supply pipe 125*a* in the downstream side of the water supply control valve 19 and the vacuum breaker 31 so as to generate electrical power based on the flow of water. The generator 16 is provided on the tank supply pipe 125*a* being a water conduit in the downstream side of the water supply pipe branching portion 33 and in the downstream side of the water supply control valve 19, but may also be provided in the downstream side of the water supply pipe branching portion 33 and the upstream side of the water supply control valve 19. That is, the generator 16 may be provided on a water conduit which is in the downstream side of the water supply pipe branching portion 33 and the upstream side of the water supply control valve 19, or on a water conduit in the downstream side of the water supply control valve 19. The generator 16 is provided on a water conduit in the downstream side of the water supply pipe branching portion 33 and the upstream side of the water supply control valve 19, or on a water conduit in the downstream side of the water supply control valve 19. Therefore the generator 16 imparts no pressure losses relative to the flow of water supplied to the discharge valve hydraulic drive portion 14 from discharge control device 118. Also, the generator 16 is provided to further the upstream side than the tank supply pipe branching portion 125*b*. Research and development by the inventors has proven that by disposing the generator 16 in this manner, the discharge valve 12 can be sufficiently driven by the discharge valve hydraulic drive portion 14. This enables providing the flush water tank apparatus 104 for supplying flush water to the flush toilet 2 by using self-generated electrical power. Since the generator 16 is provided on a water conduit in the downstream side of the water supply control valve 19. The influence of the pressure losses by the generator 16 on the discharge valve hydraulic drive portion 14 can be reduced, thereby the discharge valve hydraulic drive portion 14 can be operated more reliably. Also, the generator 16 is placed in the downstream side of the water supply control valve 19 and in a further upstream side than tank supply pipe branching portion 125*b*. Therefore electricity can be generated by using water meant to flow respectively into the reservoir tank 10 and the flush toilet main unit 2, and a sufficient quantity of electric generation can be secured, while the discharge valve hydraulic drive portion 14 is reliably operated.

The electrical power produced by the generator 16 is sent to the controller 28 connected to the generator 16, and is charged a capacitor (not shown) built into the controller 28. The flush water tank apparatus 104 comprises a float switch 29 being a water level detection device for detecting the water level in a reservoir tank. The float switch 29 is connected to the controller 28, and disposed inside the reservoir tank 10, and detects that the water level inside the reservoir tank 10 has reached to a predetermined water level $L_2$ which is lower by a predetermined distance than predetermined water level $L_1$.

The generator 16 is constituted to generate electrical power by the flow of tap water flowed out and supplied from the water supply control valve 19. Specifically, the generator 16 comprises a water wheel 17 (see FIG. 6) and generates electrical power by the rotational driving of the water wheel 17 by the flow of water in the tank supply pipe 125*a*. Electrical power produced by the generator 16 is sent to the controller 28 connected to the generator 16, thereby the electrical power is charged to a capacitor (not shown) built into the controller 28. The electrical power produced and stored by one flush of the flush toilet main unit 2 is greater than the electrical power used to operate the electromagnetic valve 20 for a single flush, therefor the electrical power used in a flush can be supplied by the generating power of the generator 16. Hence the flush water tank apparatus 4 of the present embodiment supplies flush water to the flush toilet main unit 2 by using self-generated electrical power.

The generator 16 comprises a generator casing 16*a* and an electrical parts casing 16*b* which are provided on an outside of the generator 16. Both the generator casing 16*a* and the electrical parts casing 16*b* constitute a casing of the generator 16. Elements of the generator 16 are affixed on the inside of generator casing 16*a*. The generator casing 16*a* is affixed to the electrical parts casing 16*b*. The electrical parts casing 16*b* is formed to surround the generator casing 16*a*. The electrical parts casing 16*b* is formed to affix and cover electrical parts and the like (not shown) disposed in proximity to the electrical parts casing 16*b*, such as electrical parts for the generator 16. The electrical parts casing 16*b* is formed in a box shape. If no electrical parts or the like are disposed around the generator casing 16*a*, it is possible to omit the electrical parts casing 16*b*. The generator casing 16*a* of the generator 16 or the electrical parts casing 16*b* may also be attached to the reservoir tank 10 via a tank attaching member (not shown). Even if the generator 16 is connected to the reservoir tank 10 via a tank attaching member in this manner, vibration from the generator 16 can be dispersed into water by a support member 54 described below, to reduce vibration transmission. The tank supply pipe 125*a* comprises a water inlet pipe 125*c* connected to an inlet on the generator 16, and a water outlet pipe 125*d* connected to an outlet on the generator 16.

Next, referring to FIGS. 3 through 6, a support member in a flush water tank apparatus 104 of the present embodiment is explained in detail.

The flush water tank apparatus 104 further comprises a support member 54 for supporting the casing 16*a* of the generator 16. The support member 54 may also support the electrical parts casing 16*b* when an electrical parts casing 16*b* is provided. The support member 54 further comprises a casing support member 56, which connects the overflow pipe 10*b* and the generator casing 16*a* of the generator 16 (or the electrical parts casing 16*b*). Therefore in the present embodiment support member 54 is constituted by the casing support member 56 and overflow pipe 10*b*. The support member 54 may be formed by the casing support member 56 alone, or may be formed by the casing support member 56 and the overflow pipe 10*b*. The casing support member 56 may be connected to other devices such as the discharge valve 12, the discharge valve hydraulic drive portion 14, the discharge control device 18, or the water supply control valve 19, and the support member 54 may be constituted by the casing support member 56 and other devices. Thus a portion of the support member 54 is constituted by members which extend into the water, such as the discharge valve 12, the discharge control device 18, and the water supply control valve 19, so that vibration is also transferred to the water as described below, and the vibration transferred to the reservoir tank 10 can be reduced.

The casing support member 56 comprises an annular-shaped engaging portion 56*a*, which engages with the upper portion of the overflow pipe 10*b*. The annular-shaped engaging portion 56*a* is thus affixed to the overflow pipe 10*b*. The annular-shaped engaging portion 56*a* is disposed at a position at or below dead water level $L_1$. The casing support member 56 also comprises a rising portion 56*b* which rises upward from the annular-shaped engaging portion 56*a*. The rising portion 56*b* extends parallel to the overflow pipe 10*b*. Therefore the rising portion 56*b* holds the generator 16 and the generator casing 16*a* (or the electrical parts casing 16*b*) above overflow pipe 10*b*. The rising portion 56*b* extends from a position at or below dead water level $L_1$ to a position above dead water level $L_1$. The bottom end of the rising portion 56*b* connects to the engaging portion 56*a*, and the top end of the rising portion 56*b* connects to the generator casing 16*a*. The generator 16 and the generator casing 16*a* may also be supported via the electrical parts casing 16*b* by affixing the top end of the rising portion 56*b* to the electrical parts casing 16*b*.

The support member 54 is provided so that when the water level in the reservoir tank 10 is at dead water level $L_1$, at least a portion of the support member 54 extends to a position at or below the dead water level $L_1$ of the reservoir tank 10. Therefore when the water level in the reservoir tank 10 is at dead water level $L_1$, at least a portion of the support member 54 is extending into the water in the reservoir tank 10. When the support member 54 includes a member which extends to the lower portion of the reservoir tank 10, such as the overflow pipe 10*b* for example, a state in which a portion of the support member 54 is in the water can be created, even when the water level has descended. The support member 54 is a member which supports the generator 16 relative to the reservoir tank 10. For example, the wall surface of the reservoir tank 10 itself does not constitute the support member 54. The support member 54 is a member extending from the bottom surface, wall surface, or the like of the reservoir tank 10. The support member 54, the generator casing 16*a*, and the electrical parts casing 16*b* are made of resin. The support member 54, the generator casing 16*a*, and the electrical parts casing 16*b* transfer vibration of the generator 16, but when these members are in contact with water, that vibration is also transferred to the water, and the vibration transferred by these members can be reduced.

Next the operation of the flush water tank apparatus 104 and the flush toilet apparatus 101 comprising the flush water tank apparatus 104 according to a second embodiment of the disclosure is explained.

First, in a toilet flush standby state, the water level in the reservoir tank 10 is at predetermined water level $L_1$, and the electromagnetic valve 20 is not energized. In this state, the pilot valve opening 38*a* on the main valve body 118*b* of the discharge control device 118 is in a closed state, and the discharge control device 118 is closed. The float-side pilot valve opening 44*a* pertaining to the main valve body 19*b* of the water supply control valve 19 is also in a closed state, and the water supply control valve 19 is also closed. Next, when a user presses the flush button on the remote control device 6 (FIG. 3), the remote control device 6 transmits a toilet flush command signal to controller 28 (FIG. 3). In flush toilet apparatus 1 of the present embodiment, a toilet flush command signal is transmitted to controller 28 even if a predetermined time has elapsed, without the flush button being pressed of the remote control device 6 after detection by the human sensor 8 (FIG. 3) that a user has separated from the seat.

When a toilet flush command signal is received, the controller 28 energizes the electromagnetic valve 20 and causes the electromagnetic valve-side pilot valve 118*a* to separate from the pilot valve opening 38*a* on the main valve body 118*b*. Pressure in the pressure chamber of the discharge control device 118 thus drops, and the main valve body 118*b* unseats from the valve seat 41 and is opened. In the present embodiment, a bi-stable latching solenoid is used as the electromagnetic valve 20. Therefore once the electromagnetic valve-side pilot valve 118*a* has been opened, its open state is maintained even if electrical power to it is turned off. When the discharge control device 118 is opened, tap water supplied from the water supply pipe 32 through the water supply pipe branching portion 33 and the first branch pipe 33*a* and the water supplied into the discharge control device 118 passes through the discharge control device 118 and into inflow pipe 24*a*.

In addition, water flowing into the inflow pipe 24*a* flows into the cylinder 14*a* of the discharge valve hydraulic drive portion 14, and pushes up the piston 14*b*. By pushing up piston 14*b* the lower rod 15*b* and the discharge valve 12 are pulled up, and the water discharge opening 10*a* is opened. Then, the bowl portion 2*a* of the flush toilet main unit 2 is flushed.

When water flows from the inflow pipe 24*a* into the cylinder 14*a* of the discharge valve hydraulic drive portion 14 and the piston 14*b* is pushed up to the upper portion of the cylinder 14*a*, the water in the cylinder 14*a* flows out through the outflow pipe 24*b*. Water flowing out through the outflow pipe 24*b* flows into the reservoir tank 10. A portion of water flowing into the cylinder 14*a* from the inflow pipe 24*a* flows out from the gap 14*d* between the through-hole 14*f* of the inner wall of the cylinder 14*a* and rod 15; this water then flows into the reservoir tank 10. Therefore the discharge control device 118 which supplies water to the discharge valve hydraulic drive portion 14, also functions as a water supply control device (supply valve) to control the supply and shutting off of water to the reservoir tank 10 based on the operation of the electromagnetic valve 20.

In addition, the water level in the reservoir tank 10 drops below a predetermined water level $L_1$ when flush water in the reservoir tank 10 is discharged, therefore the water supply valve float 34 descends. This causes the arm portion 34*a* to rotate so that the float-side pilot valve 19*c* separates from the float-side pilot valve opening 44*a* on main valve body 19*b*, such that the float-side pilot valve opening 44*a* is opened. As a result, pressure in the pressure chamber 37*a* within the water supply valve main body portion 19*a* of the water supply control valve 19 decreases, and the main valve body 19*b* separates from the valve seat 41. When the water supply control valve 19 is opened, tap water supplied from the water supply pipe 32 through the water supply pipe branching portion 33 and the second branched pipe 33*b* to the water supply control valve 19 flows through the water supply control valve 19 and into the tank supply pipe 125*a*. Water flowing into the tank supply pipe 125*a* reaches the generator 16. Water flowing into the generator 16 causes the water wheel 17 (see FIG. 6) in the generator 16 to rotate, as shown by arrow f (shown in FIG. 7 as arrow F), thereby generating electrical power. The generated electrical power is charged to a capacitor (not shown) built into the controller 28. Water which has passed through the generator 16 is divided in the tank supply pipe branching portion 125*b*. One part divided flows into the overflow pipe 10*b*, while the remainder flows into the reservoir tank 10. When the electrical power is generated in the generator 16, the generator 16 causes vibration. Vibration produced by the generator is transferred to the support member 54, and then transferred from the support member 54 to the water which contacts the support member 54. Vibration transferred from the generator 16 to the reservoir tank 10 via the support member 54 is therefore reduced. Noises resulting from vibration of the reservoir tank 10 can thus be suppressed.

On the other hand, when it is detected by the float switch 29 that the water level in the reservoir tank 10 has dropped to a predetermined water level $L_2$ which is lower by a predetermined distance than the predetermined water level $L_1$, the float switch 29 transmits a signal to the controller 28 that the water level in the reservoir tank 10 has dropped. When it is detected that the water level in the reservoir tank 10 has dropped, the controller 28 energizes the electromagnetic valve 20, and the controller 28 causes the electromagnetic valve-side pilot valve 118*a* to seat on the pilot valve opening 38*a* in the main valve body 118*b*. Thus pressure in the pressure chamber 36*a* of the discharge control device 118 rises, such that the main valve body 118*b* seats in the valve seat 41 and is closed. Thus after the discharge valve 12 is opened, the discharge control device 118 shuts off the supply of water to the discharge valve hydraulic drive portion 14 before the water supply control valve 19 is closed. Hence the supply of water to the discharge valve hydraulic drive portion 14 is stopped after the discharge valve 12 is opened. Therefore after the discharge valve 12 is opened, the entire amount of water supplied to the flush water tank apparatus 104 can be used for generating electricity so that a sufficient quantity of electricity which is generated can be secured while the discharge valve 12 is reliably opened by the discharge valve hydraulic drive portion 14.

That is, in the present embodiment a bistable latching solenoid is used as the electromagnetic valve 20. Therefore the electromagnetic valve-side pilot valve 118*a* can be closed by energizing the electromagnetic valve 20 by electricity with the electromagnetic valve-side pilot valve 118*a* being in an open state. When the discharge control device 118 is closed, the supply of water to the discharge valve hydraulic drive portion 14 is stopped. Thereafter the entire amount of tap water supplied from the water supply pipe 32 passes through the water supply control valve 19 into the reservoir tank 10 and is utilized for electrical generation by generator 16. When the float switch 29 detects that the water level in the reservoir tank 10 has descended to the predetermined water level $L_2$, the controller 28 closes the discharge control device 118. The water discharge control device 118 is closed when the float switch 29 detects the predetermined water level $L_2$. Therefore the opening of the discharge valve 12 can be more reliably detected and the discharge control device 118 can be closed at the appropriate timing, so that a sufficient amount of electrical generation can be assured while the discharge valve 12 is reliably opened. In contrast, as a variant example the disclosure may be constituted so that, after the controller 28 opens the discharge control device 118, then the controller 28 closes the discharge control device 118 after elapse of a predetermined time.

Meanwhile, in the discharge valve hydraulic drive portion 14, when the piston 14*b* is pushed up and, according to this movement the lower rod 15*b* and the discharge valve 12 are pulled up to a predetermined location, the clutch mechanism 22 separates the lower rod 15*b* and the discharge valve 12 from the upper rod 15*a*. By this means, while the discharge control device 118 is open, the upper rod 15*a* remains pushed upward together with the piston 14*b*, the lower rod 15*b* and the discharge valve 12 are descended by their own weight. However the separated lower rod 15*b* engages with the latching portion 26*b* of the discharge valve float mechanism 26, and the descent of the lower rod 15*b* and the discharge valve 12 is stopped. Thus even after the discharge control device 118 is closed, the water discharge opening 10*a* of the reservoir tank 10 remains in the opened state, and discharge from the reservoir tank 10 is continued.

When the water level inside the reservoir tank 10 drops to a third predetermined water level $L_3$ lower than predetermined water levels $L_1$ and $L_2$, the float portion 26*a* of the discharge valve float mechanism 26 drops, and this movement causes the latching portion 26*b* to move. This results in release of the engagement between the lower rod 15*b* and the latching portion 26*b*, so that the lower rod 15*b* and the discharge valve 12 again start to descend. The discharge valve 12 then causes the water discharge opening 10*a* of the reservoir tank 10 to close, and thus the discharge of flush water to the flush toilet main unit 2 is stopped. Because the water supply control valve 19 is in an open state even after the water discharge opening 10*a* is closed, water supplied from the water supply pipe 32 passes from the water supply control valve 19 through the tank supply pipe 125*a* and flows into the reservoir tank 10, and the water level in the reservoir tank 10 is raised.

When the water level in the reservoir tank 10 rises to the predetermined water level $L_1$, and the water supply valve float 34 rises, and the float-side pilot valve 19*c* is moved via the arm portion 34*a*, and the float-side pilot valve opening 44*a* is closed. This causes the pressure in the pressure chamber 37*a* in the main body portion 19*a* to rise, and the main valve body 19*b* is closed, so that the water supply control valve 19 is placed in a closed state. Thus the supply of water to the reservoir tank 10 is shut off.

When the water supply control valve 19 is closed, the supply of water from the water supply control valve 19 to the generator 16 is stopped, and the generation of electrical power by the generator 16 is ended. On the other hand when the supply of water to the discharge valve hydraulic drive portion 14 is stopped due to the closing of discharge control device 118, the piston 14*b* in the discharge valve hydraulic drive portion 14 is pushed down by the biasing force of the spring 14*c*. The upper rod 15*a* and the lower rod 15*b*, which had been separated by the clutch mechanism 22, are again joined when the upper rod 15*a* is pushed down together with the piston 14*b*. Therefore the next time a toilet flush is executed, the upper rod 15*a* and the lower rod 15*b* are both pulled up by the piston 14*b*. A single toilet flush is by these operations completed, and the flush toilet apparatus is returned to a toilet flush standby state.

According to the flush water tank apparatus 104 of a second embodiment of the disclosure, the support member 54 is provided so that at least a portion of the support member 54 extends to a position at or below the dead water level $L_1$ of the reservoir tank 10. Thereby vibration produced by the generator 16 can be more easily dispersed into water via the support member 54. Therefore vibration conveyed from the generator 16 through the support member 54 to the reservoir tank 10 can be reduced, so that noise emanating from the reservoir tank 10 can be suppressed.

Also, according to the flush water tank apparatus 104 of the present embodiment, vibration produced by the generator 16 can be more easily dispersed into water via the support member overflow pipe 10*b*, and vibration conveyed from the generator 16 through the support member 54 to the reservoir tank 10 can be more easily reduced, therefore noise emanating from the reservoir tank 10 can be suppressed.

Moreover, according to the flush water tank apparatus 104 of the present embodiment, vibration produced by the generator 16 can be more easily dispersed into water via the generator casing 16*a* or the electrical parts casing 16*b*, and vibration conveyed from the generator 16 through the support member 54 to the reservoir tank 10 can be more easily reduced, therefore noise emanating from the reservoir tank 10 can be further suppressed.

A flush toilet apparatus 101 comprising a flush water tank apparatus 104 of the present embodiment and a flush toilet 2 flushed by flush water supplied from the flush water tank apparatus 104. Therefore, it is possible to provide a flush toilet apparatus 101 capable of suppressing noises produced by the reservoir tank 10 in the flush water tank apparatus 104.

Figure 7:
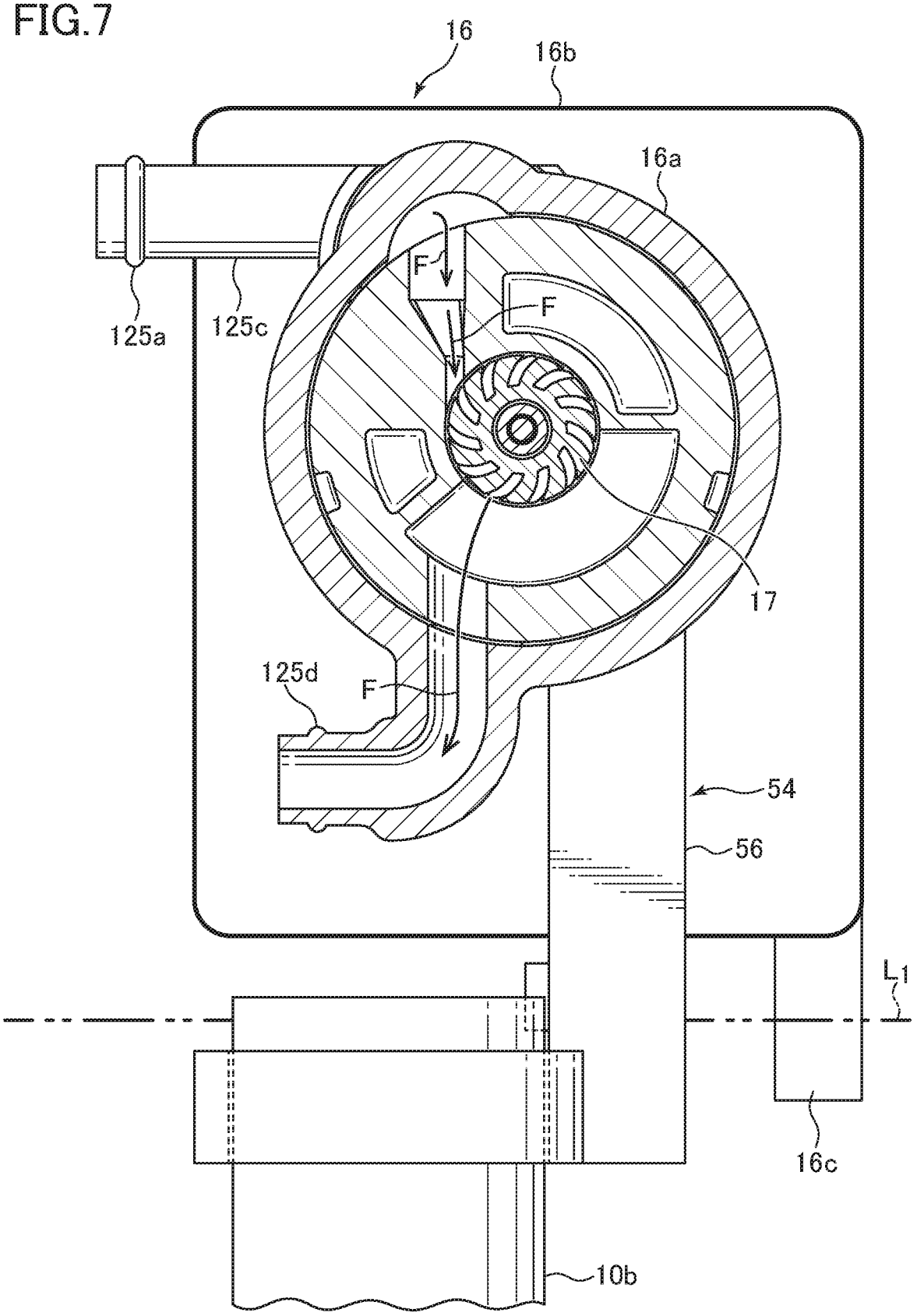
FIG. 7 is a cross sectional view showing a variant example of a casing of a generator in a flush tank apparatus according to a second embodiment of the present disclosure.

Various changes may be made to the flush water tank apparatus 104 of the second embodiment of the disclosure. For example, as a variant example, as shown in FIG. 7, the electrical parts casing 16*b* of that generator 16 may be provided so that a part of the electrical parts casing portion 16*c* extends to a position at or below the dead water level $L_1$. In this example, a part of the electrical parts casing portion 16*c* extends to further lower position than the electrical parts casing 16*b*, and extends into water. Hence vibration produced by the generator 16 can be easily dispersed via the electrical parts casing 16*b* into water. As yet a further variant example, a portion of generator casing 16*a* may be provided so as to extend to a position at or below the dead water level $L_1$.

What is claimed is:

1. A flush water tank apparatus supplying flush water to a flush toilet by using electrical power generated in the flush water tank apparatus, comprising:

a reservoir tank configured to store flush water supplied to the flush toilet, the reservoir tank including a water discharge opening configured to discharge stored flush water to the flush toilet;

a discharge valve configured to open and close the water discharge opening to supply and shut off flush water to the flush toilet;

a discharge valve hydraulic drive portion configured to drive the discharge valve by utilizing a supply pressure of supplied tap water;

a discharge control device configured to supply and shut off water to the discharge valve hydraulic drive portion so that supplied tap water flows into the discharge valve hydraulic drive portion;

an electromagnetic valve configured to control the discharge control device to open and close;

a water supply valve configured to supply and shut off water to the reservoir tank so that supplied tap water flows into the reservoir tank;

a branching portion configured to divide supplied tap water so that one part flows into the discharge control device and the other part flows into the water supply valve; and a generator configured to generate electrical power to operate the electromagnetic valve by using water flow, the generator being provided on a water conduit in a downstream side of the branching portion, and on the water conduit in an upstream side of the water supply valve or in a downstream side of the water supply valve.

2. The flush water tank apparatus of claim 1, wherein the generator is provided on the water conduit in the downstream side of the water supply valve.

3. The flush water tank apparatus of claim 2, wherein a second branching portion is provided on the water conduit in the downstream side of the water supply valve, the second branching portion being configured to divide the water flowing out from the water supply valve so that one part flows into the reservoir tank and the other part flows into the flush toilet, and the generator is provided at a further upstream side than the second branching portion.

4. The flush water tank apparatus of claim 2, wherein water flowing out from the water supply valve is guided to the generator through a flexible pipe.

5. The flush water tank apparatus of claim 2, wherein the discharge control device is configured to shut off the supply of the water to the discharge valve hydraulic drive portion after the discharge valve is opened and before the water supply valve is closed.

6. The flush water tank apparatus of claim 5, further comprising:

a water level detector configured to detect a water level inside the reservoir tank, and wherein the discharge control device is stopped when the water level detector detects a predetermined water level.

7. The flush water tank apparatus of claim 1, wherein the generator comprises a casing provided on an outside of the generator;

the flush water tank apparatus further comprises a support member supporting the casing of the generator;

and the support member is provided so that at least a portion of the support member extends to a position at or below a dead water level of the reservoir tank.

8. The flush water tank apparatus of claim 7, further comprising:

an overflow pipe configured to cause flush water flowing in from an overflow opening to discharge to the flush toilet by bypassing the water discharge opening;

wherein a part of the support member is constituted by the overflow pipe.

9. The flush water tank apparatus of claim 7, wherein the casing of the generator is provided so that a portion of the casing extends to a position at or below the dead water level.

10. A flush toilet apparatus comprising:

the flush water tank apparatus of claim 1;

wherein the flush toilet is flushed by flush water supplied from the flush water tank apparatus.

* * * * *